US009524720B2

(12) United States Patent
Li et al.

(10) Patent No.: US 9,524,720 B2
(45) Date of Patent: Dec. 20, 2016

(54) SYSTEMS AND METHODS OF BLIND BANDWIDTH EXTENSION

(71) Applicant: QUALCOMM Incorporated, San Diego, CA (US)

(72) Inventors: Sen Li, San Diego, CA (US); Stephane Pierre Villette, San Diego, CA (US); Daniel J. Sinder, San Diego, CA (US); Pravin Kumar Ramadas, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 272 days.

(21) Appl. No.: 14/334,921

(22) Filed: Jul. 18, 2014

(65) Prior Publication Data

US 2015/0170654 A1 Jun. 18, 2015

Related U.S. Application Data

(60) Provisional application No. 61/916,264, filed on Dec. 15, 2013, provisional application No. 61/939,148, filed on Feb. 12, 2014.

(51) Int. Cl.
*G10L 19/00* (2013.01)
*G10L 21/0388* (2013.01)

(52) U.S. Cl.
CPC ..... *G10L 19/00* (2013.01); *G10L 21/0388* (2013.01)

(58) Field of Classification Search
USPC ..... 704/200–232, 500–504
See application file for complete search history.

(56) References Cited

U.S. PATENT DOCUMENTS

| | | | | |
|---|---|---|---|---|
| 4,521,646 | A | 6/1985 | Callaghan | |
| 4,914,701 | A | 4/1990 | Zibman | |
| 5,455,888 | A | 10/1995 | Iyengar et al. | |
| 5,581,652 | A | 12/1996 | Abe et al. | |
| 5,644,310 | A | 7/1997 | Laczko, Sr. et al. | |
| 5,758,027 | A | 5/1998 | Meyers et al. | |
| 6,014,623 | A | 1/2000 | Wu et al. | |
| 6,044,268 | A | 3/2000 | Haartsen | |
| 6,125,120 | A | 9/2000 | Lehtimaki | |
| 6,226,616 | B1 * | 5/2001 | You | G10L 19/008 704/500 |
| 6,230,120 | B1 | 5/2001 | Suvanen | |
| 6,300,552 | B1 | 10/2001 | Sato | |

(Continued)

OTHER PUBLICATIONS

International Search Report and Written Opinion of the International Searching Authority (EPO) for International Application No. PCT/US2014/069045, mailed Mar. 4, 2015, 13 pages.

(Continued)

*Primary Examiner* — Jesse Pullias
(74) *Attorney, Agent, or Firm* — Toler Law Group, PC

(57) ABSTRACT

Systems and methods of performing blind bandwidth extension are disclosed. In an embodiment, a method includes determining, based on a set of low-band parameters of an audio signal, a first set of high-band parameters and a second set of high-band parameters. The method further includes generating a predicted set of high-band parameters based on a weighted combination of the first set of high-band parameters and the second set of high-band parameters.

31 Claims, 19 Drawing Sheets

(56) References Cited

U.S. PATENT DOCUMENTS

| | | | | |
|---|---|---|---|---|
| 6,349,197 | B1 | 2/2002 | Oestreich | |
| 6,445,686 | B1 | 9/2002 | Hoffbeck et al. | |
| 6,539,355 | B1 | 3/2003 | Omori et al. | |
| 6,681,202 | B1 | 1/2004 | Miet et al. | |
| 6,842,733 | B1 | 1/2005 | Gao et al. | |
| 7,072,366 | B2 * | 7/2006 | Parkkinen | G10L 19/24 348/401.1 |
| 7,088,704 | B1 | 8/2006 | Byers et al. | |
| 7,469,206 | B2 * | 12/2008 | Kjorling | G10L 19/0017 704/205 |
| 7,720,676 | B2 * | 5/2010 | Philippe | G10L 19/005 370/537 |
| 7,953,604 | B2 | 5/2011 | Mehrotra et al. | |
| 8,392,198 | B1 | 3/2013 | Berisha et al. | |
| 8,532,983 | B2 | 9/2013 | Gao | |
| 2001/0044722 | A1 | 11/2001 | Gustafsson et al. | |
| 2002/0007280 | A1 | 1/2002 | McCree | |
| 2002/0131377 | A1 | 9/2002 | DeJaco et al. | |
| 2003/0093278 | A1 | 5/2003 | Malah | |
| 2004/0138876 | A1 | 7/2004 | Kallio et al. | |
| 2004/0254786 | A1 | 12/2004 | Kirla et al. | |
| 2005/0273322 | A1 * | 12/2005 | Lee | H04S 1/007 704/212 |
| 2007/0299669 | A1 | 12/2007 | Ehara | |
| 2008/0126085 | A1 | 5/2008 | Morii | |
| 2008/0129350 | A1 | 6/2008 | Mitsufuji et al. | |
| 2008/0177532 | A1 | 7/2008 | Greiss et al. | |
| 2009/0292537 | A1 | 11/2009 | Ehara et al. | |
| 2010/0169081 | A1 | 7/2010 | Yamanashi et al. | |
| 2012/0076323 | A1 | 3/2012 | Disch et al. | |
| 2012/0239388 | A1 | 9/2012 | Sverrisson et al. | |
| 2013/0144614 | A1 | 6/2013 | Myllyla et al. | |
| 2015/0170655 | A1 | 6/2015 | Li et al. | |

OTHER PUBLICATIONS

Jax, P. et al., "On Artificial Bandwidth Extension of Telephone Speech", Signal Processing, Elsevier Science Publishers B.V., Amsterdam, NL, vol. 83, No. 8, dated Aug. 1, 2003, pp. 1707 through 1719.

Laaksonen, L. et al., "Artificial Bandwidth Expansion Method to Improve Intelligibility and Quality of AMR Coded Narrowband Speech", International Conference on Acoustics, Speech and Signal Processing (ICASSP), IEEE, 2005, pp. 809 through 812.

Nour-Eldin, A., "Quantifying and Exploiting Speech Memory for the Improvement of Narrowband Speech Bandwidth Extension", Nov. 1, 2013, pp. 1 through 336.

Soon, I. et al., "Bandwidth Extension of Narrowband Speech Using Soft-decision Vector Quantization", Information Communications and Signal Processing, 2005 Fifth International Conference on Bangkok, Thailand, Piscataway, NJ, USA, IEEE, dated Dec. 6, 2005, pp. 734 through 738.

* cited by examiner

X is modeled conceptually by:

$$(1/d_1)*Y_1 + (1/d_2)*Y_2 + (1/d_3)*Y_3$$

SYSTEMS AND METHODS OF BLIND BANDWIDTH EXTENSION

CLAIM OF PRIORITY

The present application claims priority from U.S. Provisional Application No. 61/916,264, filed Dec. 15, 2013, which is entitled "SYSTEMS AND METHODS OF BLIND BANDWIDTH EXTENSION," and from U.S. Provisional Application No. 61/939,148, filed Feb. 12, 2014, which is entitled "SYSTEMS AND METHODS OF BLIND BANDWIDTH EXTENSION," the content of which is incorporated by reference in its entirety.

FIELD

The present disclosure is generally related to blind bandwidth extension.

DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet Protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player.

In traditional telephone systems (e.g., public switched telephone networks (PSTNs)), voice and other signals are sampled at about 8 kilohertz (kHz), limiting the signal frequencies of a represented signal to less than 4 kHz. In wideband (WB) applications, such as cellular telephony and voice over internet protocol (VoIP), the voice and other signals may be sampled at about 16 kHz. WB applications enable representation of signals with frequencies of up to 8 kHz. Extending signal bandwidth from narrowband (NB) telephony, limited to 4 kHz, to WB telephony of 8 kHz may improve speech intelligibility and naturalness.

WB coding techniques typically involve encoding and transmitting the lower frequency portion of the signal (e.g., 0 Hz to 4 kHz, also called the "low-band"). For example, the low-band may be represented using filter parameters and/or a low-band excitation signal. However, in order to improve coding efficiency, the higher frequency portion of the signal (e.g., 4 kHz to 8 kHz, also called the "high-band") may be encoded to generate a smaller set of parameters that are transmitted with the low-band information. As the amount of high-band information is reduced, bandwidth transmission is more efficiently used, but accurate reconstruction of the high-band at a receiver may have reduced reliability.

SUMMARY

Systems and methods of performing blind bandwidth extension are disclosed. In a particular embodiment, a low-band input signal (representing a low-band portion of an audio signal) is received. High-band parameters (e.g., line spectral frequencies (LSF), gain shape information, gain frame information, and/or other information descriptive of the high-band audio signal) may be predicted using the low-band portion of the audio signal according to states based on soft-vector quantization. For example, a particular state may correspond to particular low-band gain frame parameters (e.g., corresponding to a low-band frame or sub-frame). Using predicted state transition information, gain frame information associated with the high-band portion of the audio signal may be predicted based on low-band gain frame information extracted from the low-band portion of the audio signal. A known or predicted state corresponding to particular gain frame parameters may be used to predict additional gain frame parameters that correspond to additional frames/sub-frames. The predicted high-band parameters may be applied to a high-band model (with a low-band residual signal corresponding to the low-band portion of the audio signal) to generate a high-band portion of the audio signal. The high-band portion of the audio signal may be combined with the low-band portion of the audio signal to produce a wideband output.

In a particular embodiment, a method includes determining, based on a set of low-band parameters of an audio signal, a first set of high-band parameters and a second set of high-band parameters. The method further includes generating a predicted set of high-band parameters based on a weighted combination of the first set of high-band parameters and the second set of high-band parameters.

In another particular embodiment, a method includes receiving a set of low-band parameters corresponding to a frame of an audio signal. The method further includes selecting, based on the set of low-band parameters, a first quantization vector from a plurality of quantization vectors and a second quantization vector from the plurality of quantization vectors. The first quantization vector is associated with a first set of high-band parameters and the second quantization vector is associated with a second set of high-band parameters. The method also includes predicting a set of high-band parameters based on a weighted combination of the first set of high-band parameters and the second set of high-band parameters.

In another particular embodiment, a method includes receiving a set of low-band parameters corresponding to a frame of an audio signal. The method further includes predicting a set of non-linear domain high-band parameters based on the set of low-band parameters. The method also includes converting the set of non-linear domain high-band parameters from a non-linear domain to a linear domain to obtain a set of linear domain high-band parameters.

In another particular embodiment, a method includes receiving a set of low-band parameters corresponding to a frame of an audio signal. The method further includes selecting, based on the set of low-band parameters, a first quantization vector from a plurality of quantization vectors and a second quantization vector from the plurality of quantization vectors. The first quantization vector is associated with a first set of high-band parameters and the second quantization vector is associated with a second set of high-band parameters. The method also includes predicting a set of high-band parameters based on a weighted combination of the first set of high-band parameters and the second set of high-band parameters.

In another particular embodiment, a method includes selecting a first quantization vector of a plurality of quantization vectors. The first quantization vector corresponds to a first set of low-band parameters corresponding to a first frame of an audio signal. The method further includes receiving a second set of low-band parameters corresponding to a second frame of the audio signal. The method also includes determining, based on entries in a transition probability matrix, bias values associated with transitions from the first quantization vector corresponding to the first frame to candidate quantization vectors corresponding to the second frame. The method includes determining weighted differences between the second set of low-band parameters and the candidate quantization vectors based on the bias values. The method further includes selecting a second quantization vector corresponding to the second frame based on the weighted differences.

In another particular embodiment, a method includes receiving a set of low-band parameters corresponding to a frame of an audio signal. The method further includes classifying the set of low-band parameters as voiced or unvoiced. The method also includes selecting a quantization vector. The quantization vector corresponds to a first plurality of quantization vectors associated with voiced low-band parameters when the set of low-band parameters is classified as voiced low-band parameters. The quantization vector corresponds to a second plurality of quantization vectors associated with unvoiced low-band parameters when the set of low-band parameters is classified as unvoiced low-band parameters. The method includes predicting a set of high-band parameters based on the selected quantization vector.

In another particular embodiment, a method includes receiving a first set of low-band parameters corresponding to a first frame of an audio signal. The method further includes receiving a second set of low-band parameters corresponding to a second frame of the audio signal. The second frame is subsequent to the first frame within the audio signal. The method also includes classifying the first set of low-band parameters as voiced or unvoiced and classifying the second set of low-band parameters as voiced or unvoiced. The method includes selectively adjusting a gain parameter based at least partially on a classification of the first set of low-band parameters, a classification of the second set of low-band parameters, and an energy value corresponding to the second set of low-band parameters.

In another particular embodiment, a method includes receiving, at a decoder of a speech vocoder, a set of low-band parameters as part of a narrowband bitstream. The set of low-band parameters are received from an encoder of the speech vocoder. The method also includes predicting a set of high-band parameters based on the set of low-band parameters.

In another particular embodiment, an apparatus includes a speech vocoder and a memory storing instructions executable by the speech vocoder to perform operations. The operations include receiving, at a decoder of the speech vocoder, a set of low-band parameters as part of a narrowband bitstream. The set of low-band parameters are received from an encoder of the speech vocoder. The operations also include predicting a set of high-band parameters based on the set of low-band parameters.

In another particular embodiment, a non-transitory computer-readable medium includes instructions, that when executed by a speech vocoder, cause the speech vocoder to receive, at a decoder of the speech vocoder, a set of low-band parameters as part of a narrowband bitstream. The set of low-band parameters are received from an encoder of the speech vocoder. The instructions are also executable to cause the speech vocoder to predict a set of high-band parameters based on the set of low-band parameters.

In another particular embodiment, an apparatus includes means for receiving a set of low-band parameters as part of a narrowband bitstream. The set of low-band parameters are received from an encoder of a speech vocoder. The apparatus also includes means for predicting a set of high-band parameters based on the set of low-band parameters.

Particular advantages provided by at least one of the disclosed embodiments include generating high-band signal parameters from low-band signal parameters without the use of high-band side information, thereby reducing the amount of data transmitted. For example, high-band parameters corresponding to a high-band portion of an audio signal may be predicted based on low-band parameters corresponding to a low-band portion of the audio signal. Using soft-vector quantization may reduce audible effects due to transitions between states and compared to high-band prediction systems that use hard vector quantization. Using predicted state transition information may increase the accuracy of the predicted high-band parameters as compared to high-band prediction systems that do not use predicted state transition information. Other aspects, advantages, and features of the present disclosure will become apparent after review of the entire application, including the following sections: Brief Description of the Drawings, Detailed Description, and the Claims.

DETAILED DESCRIPTION

Figure 1:
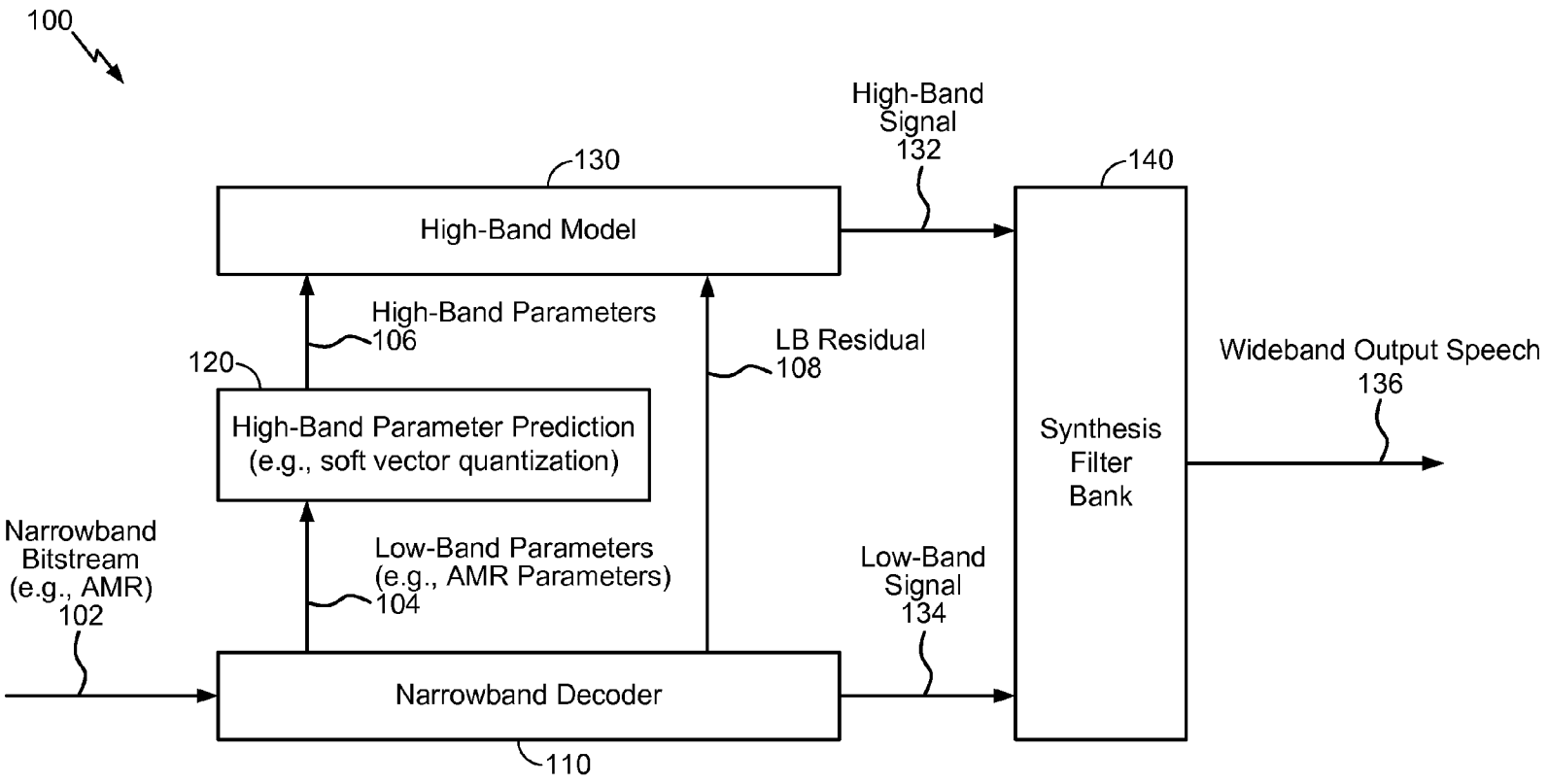
FIG. 1 is a block diagram to illustrate a particular embodiment of a system that is operable to perform blind bandwidth extension using soft vector quantization.

Referring to FIG. 1, a particular embodiment of a system that is operable to perform blind bandwidth extension using soft vector quantization is depicted and generally designated 100. The system 100 includes a narrowband decoder 110, a high-band parameter prediction module 120, a high-band model module 130, and a synthesis filter bank module 140. The high-band parameter prediction module 120 may enable the system 100 to predict high-band parameters based on low-band parameters extracted from a narrowband signal. In a particular embodiment, the system 100 may be integrated into an encoding system or apparatus (e.g., in a wireless telephone or coder/decoder (CODEC)).

In the following description, various functions performed by the system 100 of FIG. 1 are described as being performed by certain components or modules. However, this division of components and modules is for illustration only. In an alternate embodiment, a function performed by a particular component or module may instead be divided amongst multiple components or modules. Moreover, in an alternate embodiment, two or more components or modules of FIG. 1 may be integrated into a single component or module. Each component or module illustrated in FIG. 1 may be implemented using hardware (e.g., an application-specific integrated circuit (ASIC), a digital signal processor (DSP), a controller, a field-programmable gate array (FPGA) device, etc.), software (e.g., instructions executable by a processor), or any combination thereof.

Although the disclosed systems and methods of FIGS. 1-16 are described with reference to receiving a transmission of an audio signal, the systems and methods may also be implemented in any instance of bandwidth extension. For example, all or part of the disclosed systems and methods may be performed and/or included at a transmitting device. To illustrate, the disclosed systems and methods may be applied during encoding of the audio signal to generate "side information" for use in decoding the audio signal.

The narrowband decoder 110 may be configured to receive a narrowband bitstream 102 (e.g., an adaptive multi-rate (AMR) bitstream). The narrowband decoder 110 may be configured to decode the narrowband bitstream 102 to recover a low-band audio signal 134 corresponding to the narrowband bitstream 102. In a particular embodiment, the low-band audio signal 134 may represent speech. As an example, a frequency of the low-band audio signal 134 may range from approximately 0 hertz (Hz) to approximately 4 kilohertz (kHz). The narrowband decoder 110 may further be configured to generate low-band parameters 104 based on the narrowband bitstream 102. The low-band parameters 104 may include linear prediction coefficients (LPC), line spectral frequencies (LSF), gain shape information, gain frame information, and/or other information descriptive of the low-band audio signal 134. In a particular embodiment, the low-band parameters 104 include AMR parameters corresponding to the narrowband bitstream 102. The narrowband decoder 110 may further be configured to generate low-band residual information 108. The low-band residual information 108 may correspond to a filtered portion of the low-band audio signal 134. Although FIG. 1 is described in terms of receiving a narrowband bitstream, other forms of narrowband signals (e.g., a narrowband continuous phase modulation signal (CPM)) may be used by the narrowband decoder 110 to recover the low-band audio signal 134, the low-band parameters 104, and the low-band residual information 108.

The high-band parameter prediction module 120 may be configured to receive the low-band parameters 104 from the narrowband decoder 110. Based on the low-band parameters 104, the high-band parameter prediction module 120 may generate predicted high-band parameters 106. The high-band parameter prediction module 120 may use soft vector quantization to generate the predicted high-band parameters 106, such as in accordance with one or more of the embodiments described with reference to FIGS. 3-16. By using soft vector quantization, a more accurate prediction of the high-band parameters may be enabled as compared to other high-band prediction methods. Further, the soft vector quantization enables a smooth transition between changing high-band parameters over time.

The high-band model module 130 may use the predicted high-band parameters 106 and the low-band residual information 108 to generate a high-band signal 132. As an example, a frequency of the high-band signal 132 may range from approximately 4 kHz to approximately 8 kHz. The synthesis filter bank 140 may be configured to receive the high-band signal 132 and the low-band signal 134 and generate a wideband output 136. The wideband output 136 may include a wideband speech output that includes the decoded low-band audio signal 134 and the predicted high-band audio signal 132. A frequency of the wideband output 136 may range from approximately 0 Hz to approximately 8 kHz, as an illustrative example. The wideband output 136 may be sampled (e.g., at approximately 16 kHz) to reconstruct the combined low-band and high-band signals. Using soft vector quantization may reduce inaccuracies in the wideband output 136 due to inaccurately predicted high-band parameters thereby reducing audible artifacts in the wideband output 136.

Although the description of FIG. 1 relates to predicting high-band parameters based on low-band parameters retrieved from a narrowband bitstream, the system 100 may be used for bandwidth extension by predicting parameters of any band of an audio signal. For example, in an alternate embodiment, the high-band parameter prediction module 120 may predict super high-band (SHB) parameters based on high-band parameters using the methods described herein to generate a super high-band audio signal with a frequency that ranges from approximately 8 kHz to approximately 16 kHz.

Figure 2:
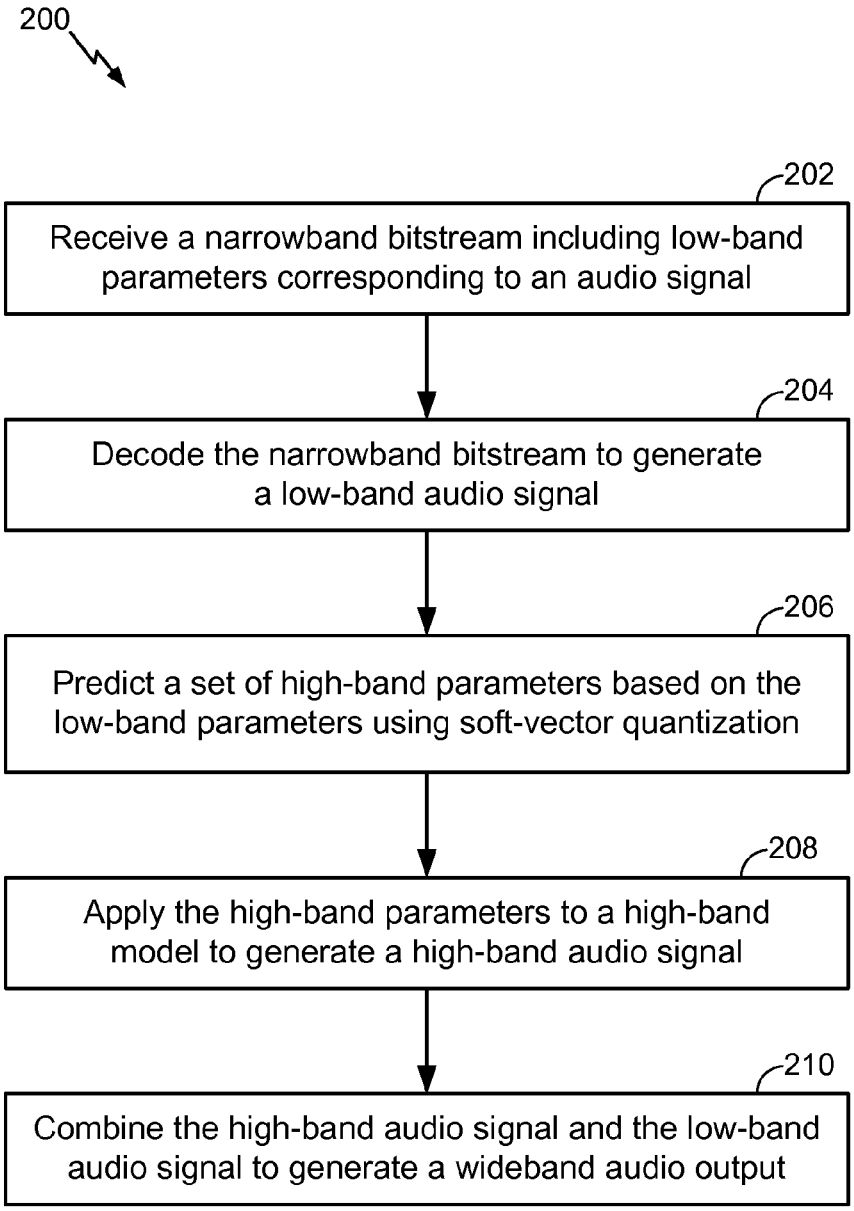
FIG. 2 is a flowchart to illustrate a particular embodiment of a method of performing blind bandwidth extension.

Referring to FIG. 2, a particular embodiment of a method 200 of performing blind bandwidth extension includes receiving an input signal, such as a narrowband bitstream including low-band parameters corresponding to an audio signal, at 202. For example, the narrowband decoder 110 may receive the narrowband bitstream 102.

The method 200 may further include decoding the narrowband bitstream to generate a low-band audio signal (e.g., the low-band signal 134 of FIG. 1), at 204. The method 200 also includes predicting a set of high-band parameters based on the low-band parameters using soft-vector quantization, at 206. For example, the high-band parameter prediction module 120 may predict the high-band parameters 106 based on the low-band parameters 104 using soft vector quantization.

The method 200 includes applying the high-band parameters to a high-band model to generate a high-band audio signal, at 208. For example, the high-band parameters 106 may be applied to the high-band model 130 along with the low-band residual 108 received from the narrowband decoder 110. The method 200 further includes combining (e.g., at the synthesis filter bank 140 of FIG. 1) the high-band audio signal and the low-band audio signal to generate a wideband audio output, at 210.

Using the soft vector quantization according to the method 200 may reduce inaccuracies in wideband output due to inaccurately predicted high-band parameters and therefore may reduce audible artifacts in the wideband output.

Figure 3:
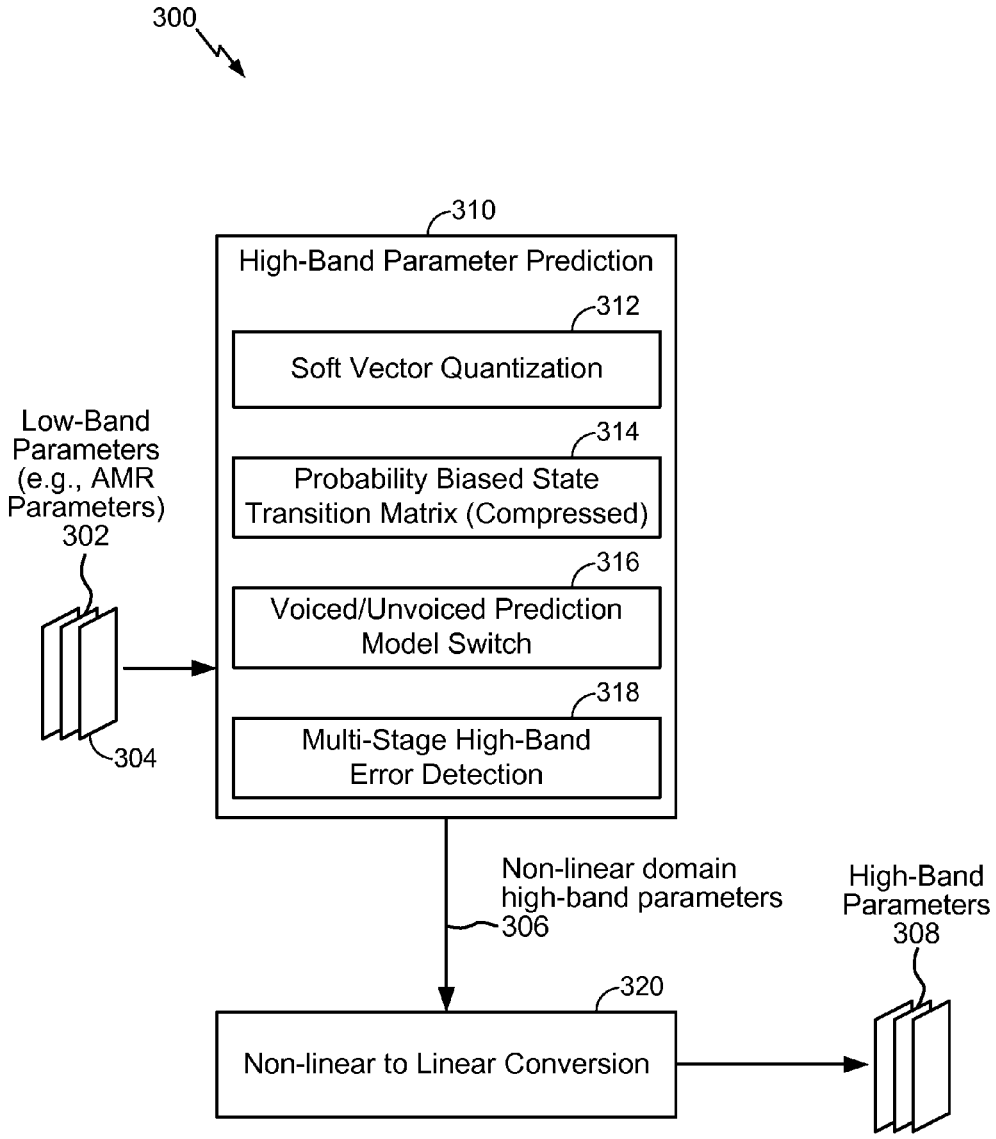
FIG. 3 is a diagram to illustrate a particular embodiment of a system that is operable to perform blind bandwidth extension using soft vector quantization.

Referring to FIG. 3, a particular embodiment of a system that is operable to perform blind bandwidth extension using soft vector quantization is depicted and generally designated 300. The system 300 includes a high-band parameter prediction module 310 and is configured to generate high-band parameters 308. The high-band parameter prediction module 310 may correspond to the high-band parameter prediction module 120 of FIG. 1. The system 300 may be configured to generate non-linear domain high-band parameters 306 and may include a non-linear to linear conversion module 320. High-band parameters generated in the non-linear domain may more closely follow the human auditory system response, thereby creating a more accurate wideband voice signal and may be transformed from non-linear domain high-band parameters to linear domain high-band parameters is with relatively little computational complexity. The high-band parameter prediction module 310 may be configured to receive low-band parameters 302 corresponding to a low-band audio signal. The low-band audio signal may be incrementally divided into frames. For example, the low-band parameters may include a set of parameters corresponding to a frame 304 of the audio signal. The set of low-band parameters corresponding to the frame 304 of the audio signal may include AMR parameters (e.g., LPCs, LSFs, gain shape parameters, gain frame parameters, etc.). The high-band parameter prediction module 310 may be further configured to generate predicted non-linear domain high-band parameters 306 based on the low-band parameters 302. In a particular non-limiting embodiment, the system 300 may be configured to generate high-band n-th root domain (e.g., cubic root domain, 4th root domain, etc.) high-band parameters and the non-linear to linear conversion module 320 may be configured to convert the n-th root domain parameters to the linear domain.

The high-band parameter prediction module 310 may include a soft vector quantization module 312, a probability biased state transition matrix 314, a voiced/unvoiced prediction model switch module 316, and/or a multi-stage high-band error detection module 318.

The soft vector quantization module 312 may be configured to determine a set of matching low-band to high-band quantization vectors for a received set of low-band parameters. For example, the set of low-band parameters corresponding to the frame 304 may be received at the soft vector quantization module 312. The soft vector quantization module may select multiple quantization vectors from a vector quantization table (e.g., a codebook) that best match the set of low-band parameters, such as described in further detail with reference to FIG. 5. The vector quantization table may be generated based on training data. The soft vector quantization module may predict a set of high-band parameters based on the multiple quantization vectors. For example, the multiple quantization vectors may map sets of quantized low-band parameters to sets of quantized high-band parameters. A weighted sum may be implemented to determine a set of high-band parameters from the sets of quantized high-band parameters. In the embodiment of FIG. 3, the set of high-band parameters are determined within the non-linear domain.

In selecting vectors from the vector quantization table that best match the set of low-band parameters, differences between the set of low-band parameters and the quantized low-band parameters of each quantization vector may be calculated. The calculated differences may be scaled, or weighted, based on a determination of a state (e.g., a closest matching quantized set) of the low-band parameters. The probability biased state transition matrix 314 may be used to determine a plurality of weights in order to weight the calculated differences. The plurality of weights may be calculated based on bias values corresponding to probabilities of transition from a current set of quantized low-band parameters to a next set of quantized low-band parameters of the vector quantization table (e.g., corresponding to a next received frame of the audio signal). The multiple quantization vectors selected by the soft vector quantization module 312 may be selected based on the weighted differences. In order to conserve resources, the probability biased state transition matrix 314 may be compressed. Examples of probability biased state transition matrices that may be used in FIG. 3 are further described with reference to FIGS. 9 and 10.

The voiced/unvoiced prediction model switch module 316 may provide a first codebook for use by the soft vector quantization module 312 when the received set of low-band parameters corresponds to a voiced audio signal and a second codebook when the received set of low-band parameters corresponds to an unvoiced audio signal, such as further described with reference to FIG. 12.

The multi-stage high-band error detection module 318 may analyze the non-linear domain high-band parameters generated by the soft vector quantization module 312, the probability biased state transition matrix 314, and the voiced/unvoiced prediction model switch 316 to determine whether a high-band parameter (e.g., a gain frame parameter) may be unstable (e.g., corresponding to an energy value that is disproportionately higher than an energy value of a prior frame) and/or may lead to noticeable artifacts in the generated wide band audio signal. In response to determining that a high-band prediction error has occurred, the multi-stage high-band error detection module 318 may attenuate or otherwise correct the non-linear domain high-band parameters. Examples of multi-stage high-band error detection are further described with reference to FIGS. 14 and 15.

After the set of non-linear domain high-band parameters 306 are generated by the high-band parameter prediction module 310, the non-linear to linear conversion module 320 may convert the non-linear domain high-band parameters to the linear domain, thereby generating high-band parameters 308. Performing high-band parameter prediction in the non-linear domain, as opposed to the linear domain or the log domain, may enable the high-band parameters to more closely model the human auditory response. Further, the non-linear domain model may be selected to have a concavity, such that the non-linear domain model attenuates a weighted sum output of the soft vector quantization module 312 that does not clearly match a particular state (e.g., quantization vector). An example of concavity may include functions that satisfy the property:

$$f\left(\frac{x_1+x_2}{2}\right) \geq \frac{f(x_1)+f(x_2)}{2}$$

Examples of concave functions may include logarithmic type functions, n-th root functions, one or more other concave functions, or expressions that include one or more concave components and that may further include a non-concave component. For example, a set of low-band parameters that falls equidistant from two quantization vectors within the soft vector quantization module 312 results in high-band parameters with a lower energy value than if the set of low-band parameters is equal to one or the other of the quantization vectors. The attenuation of less exact matches between low-band parameters and quantized low-band parameters enables high-band parameters that are predicted with less certainty to have less energy, thereby reducing the chance for erroneous high-band parameters from being audible within the output wideband audio signal.

Although FIG. 3 illustrates a soft vector quantization module 312, other embodiments may not include the soft vector quantization module 312. Although FIG. 3 illustrates a probability biased state transition matrix 314, other embodiments may not include the probability biased state transition matrix 314 and may instead select states independently of transition probabilities between states. Although FIG. 3 illustrates a voiced unvoiced prediction model switch module 316, other embodiments may not include the voiced/unvoiced prediction model switch module 316 and may instead use a single codebook or combination of codebooks that are not distinguished based on voiced and unvoiced classifications. Although FIG. 3 illustrates the multistage high-band error detection module 318, other embodiments may not include the multistage high-band error detection module 318 and may instead include a single stage error detection or may omit error detection.

Figure 4:
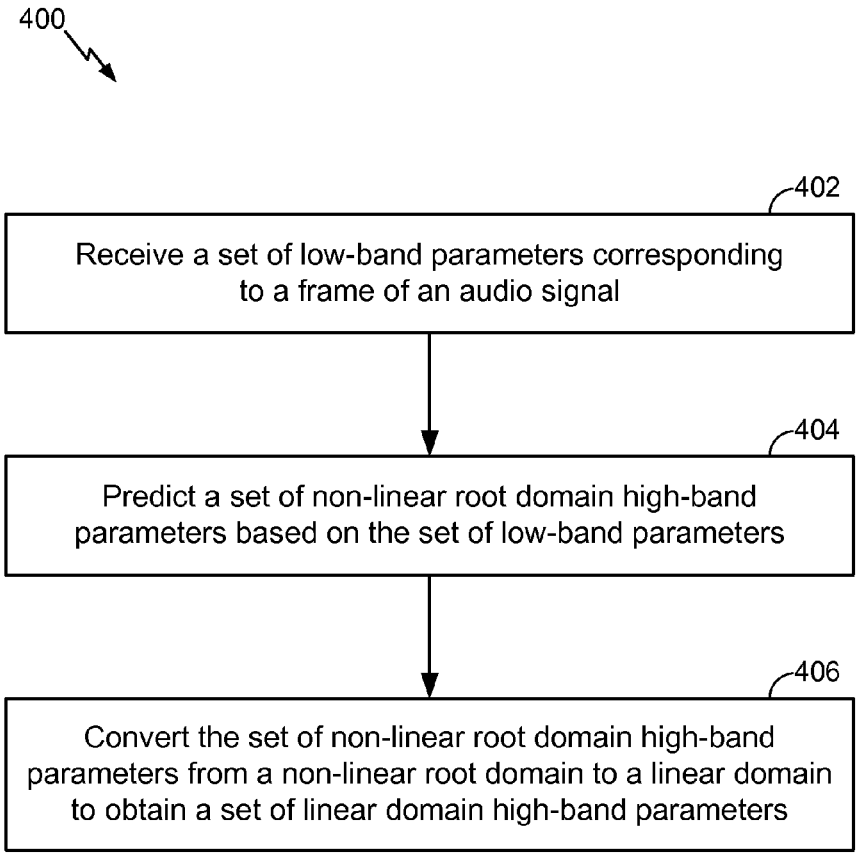
FIG. 4 is a flowchart to illustrate another particular embodiment of a method of performing blind bandwidth extension.

Referring to FIG. 4, a particular embodiment of a method 400 of performing blind bandwidth extension includes receiving a set of low-band parameters corresponding to a frame of an audio signal, at 402. For example, the high-band parameter prediction module 310 may receive the set of low-band parameters 304.

The method 400 further includes predicting a set of non-linear domain high-band parameters based on the set of low-band parameters, at 404. For example, the high-band parameters prediction module 310 may use soft vector quantization in the non-linear domain to produce non-linear domain high-band parameters.

The method 400 also includes converting the set of non-linear domain high-band parameters from a non-linear domain to a linear domain to obtain a set of linear domain high-band parameters, at 406. For example, the non-linear to linear conversion module 320 may perform a multiplication operation to convert the non-linear high-band parameters into linear domain high-band parameters. To illustrate, a cubing operation applied to a value A may be denoted as $A^3$ and may correspond to A*A*A. In this example, A is a cubic root (e.g., a 3-rd root) domain value of $A^3$.

Performing high-band parameter prediction in the non-linear domain may more closely match the human auditory system and may reduce the likelihood that erroneous high-band parameters generate audible artifacts within the output wideband audio signal.

Figure 5:
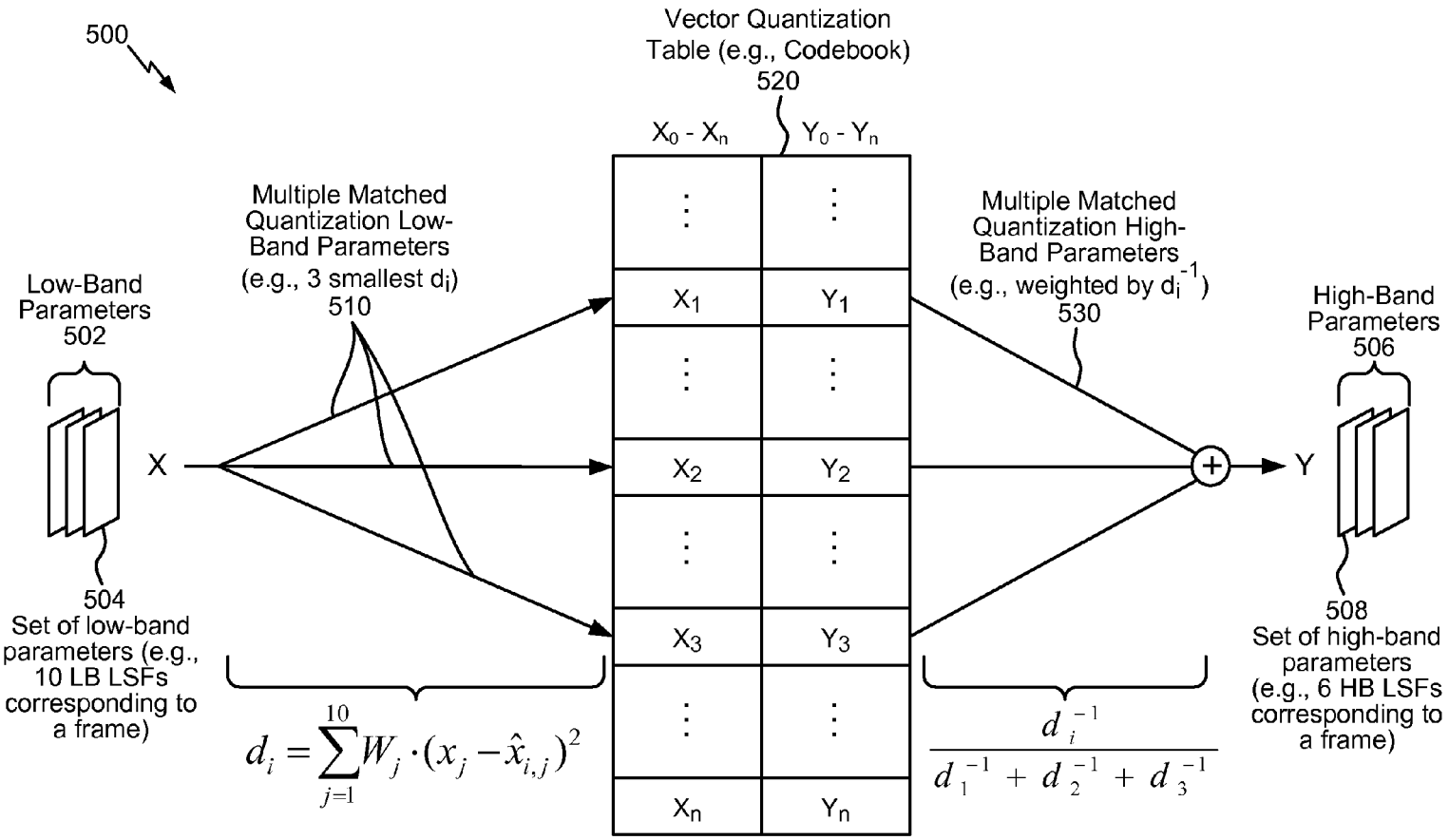
FIG. 5 is a diagram to illustrate a particular embodiment of a soft vector quantization module of FIG. 3.

Referring to FIG. 5, a particular embodiment of a soft vector quantization module, such as the soft vector quantization module 312 of FIG. 3, is depicted and generally designated 500. The soft vector quantization module 500 may include a vector quantization table 520. Soft vector quantization may include selecting multiple quantization vectors from the vector quantization table 520 and generating a weighted sum output based on the multiple selected quantization vectors in contrast to hard vector quantization, which includes selecting one quantization vector. The weighted sum output of soft vector quantization may be more accurate than a quantized output of hard vector quantization.

To illustrate, the vector quantization table 520 may include a codebook that maps quantized low-band parameters "X" (e.g., an array of sets of low-band parameters $X_0$-$X_n$) to high-band parameters "Y" (e.g., an array of sets of high-band parameters $Y_0$-$Y_n$). In an embodiment, the low-band parameters may include 10 low-band LSFs corresponding to a frame of an audio signal and the high-band parameters may include 6 high-band LSFs corresponding to the frame of the audio signal.

The vector quantization table 520 may be generated based on training data. For example, a database including wideband speech samples may be processed to extract low-band LSFs and corresponding high-band LSFs. From the wideband speech samples, similar low-band LSFs and corresponding high-band LSFs may be classified into multiple states (e.g., 64 states, 256 states, etc.). A centroid (or mean or other measure) corresponding to a distribution of low-band parameters in each state may correspond to quantized low-band parameters $X_0$-$X_n$ within an array of low-band parameters X and centroids corresponding to a distribution of high-band parameters in each state may correspond to quantized high-band parameters $Y_0$-$Y_n$ within an array of high-band parameters Y. Each set of quantized low-band parameters may be mapped to a corresponding set of high-band parameters to form a quantization vector (e.g., a row of the vector quantization table 520).

In soft vector quantization, low-band parameters 502 corresponding to a low-band audio signal may be received by a soft vector quantization module (e.g., the soft vector quantization module 312 of FIG. 3). The low-band audio signal may be divided into a plurality of frames. A set of low-band parameters 504 may correspond to a frame of the narrowband audio signal. For example, the set of low-band parameters may include a set of LSFs (e.g., 10) extracted from the frame of the low-band audio signal. The set of low-band parameters may be compared to the quantized low-band parameters $X_0$-$X_n$ of the vector quantization table 520. For example, a distance between the set of low-band parameters and the quantized low-band parameters $X_0$-$X_n$ may be determined according to the equation:

$$d_i = \sum_{j=1}^{10} W_j * (x_j - \hat{x}_{i,j})^2$$

where $d_i$ is a distance between the set of low-band parameters and an i-th set of quantized low-band parameters, $W_j$ is a weight associated with each low-band parameter of the set of low-band parameters, $x_j$ is a low-band parameter having index j of the set of low-band parameters, and $\hat{x}_{i,j}$ is a quantized low-band parameter having index j of the i-th set of quantized low-band parameters.

Multiple quantized low-band parameters 510 may be matched to the set of low-band parameters 504 based on the distance between the set of low-band parameters 504 and the quantized low-band parameters. For example, the closest quantized low-band parameters (e.g., $x_i$ resulting in a smallest $d_i$) may be selected. In an embodiment, three quantized low-band parameters may be selected. In other embodiments, any number of multiple quantized low-band parameters 510 may be selected. Further, the number of multiple quantized low-band parameters 510 may adaptively change from frame to frame. For example, a first number of quantized low-band parameters 510 may be selected for a first frame of the audio signal and a second number including more or fewer quantized low-band parameters may be selected for a second frame of the audio signal.

Based on the selected multiple quantized low-band parameters 510, multiple corresponding quantized high-band parameters 530 may be determined. A combination, such as a weighted sum, may be performed on the multiple quantized high-band parameters 530 to obtain a set of predicted high-band parameters 508. For example, the set of predicted high-band parameters 508 may include 6 high-band LSFs corresponding to the frame of the low-band audio signal. High-band parameters 506 corresponding to the low-band audio signal may be generated based on multiple sets of predicted high-band parameters and may correspond to multiple sequential frames of the audio signal.

The multiple high-band parameters 530 may be combined as a weighted sum, where each selected quantized high-band parameter may be weighted based on the inverse distance $d_i^{-1}$ between the corresponding quantized low-band parameter and the received low-band parameter. To illustrate, when three quantized high-band parameters are selected, as illustrated in FIG. 5, each of the selected quantized high-band parameters 530 may be weighted according to the value:

$$\frac{d_i^{-1}}{d_1^{-1}+d_2^{-1}+d_3^{-1}}$$

where $d_i^{-1}$ is the inverse distance between the set of low-band parameters and the first, second, or third selected quantized set of low-band parameters corresponding to the quantized high-band parameters to be weighted and $d_1^{-1}+d_2^{-1}$ $d_3^{-1}$ corresponds to the sum of each of the inverse distances between the set of low-band parameters and each of the selected quantized sets of low-band parameters corresponding to each of the quantized high-band parameters. Hence, the output set of high-band parameters 508 may be represented by the equation:

$$\text{output} = \frac{d_1^{-1}}{d_1^{-1}+d_2^{-1}+d_3^{-1}}y(i_1)+\frac{d_2^{-1}}{d_1^{-1}+d_2^{-1}+d_3^{-1}}y(i_2)+\frac{d_3^{-1}}{d_1^{-1}+d_2^{-1}+d_3^{-1}}y(i_3)$$

where $y(i_1)$, $y(i_2)$, and $y(i_3)$ are the selected multiple quantized high-band parameters. By weighting multiple quantized high-band parameters to determine a predicted set of quantized high-band parameters, a more accurate output set of high-band parameters 508 corresponding to the set of low-band parameters 504 may be predicted. Further, as the low-band parameters 502 change gradually over the course of multiple frames, the predicted high-band parameters 506 may also change gradually, as described with reference to FIGS. 6 and 7.

Figure 6:
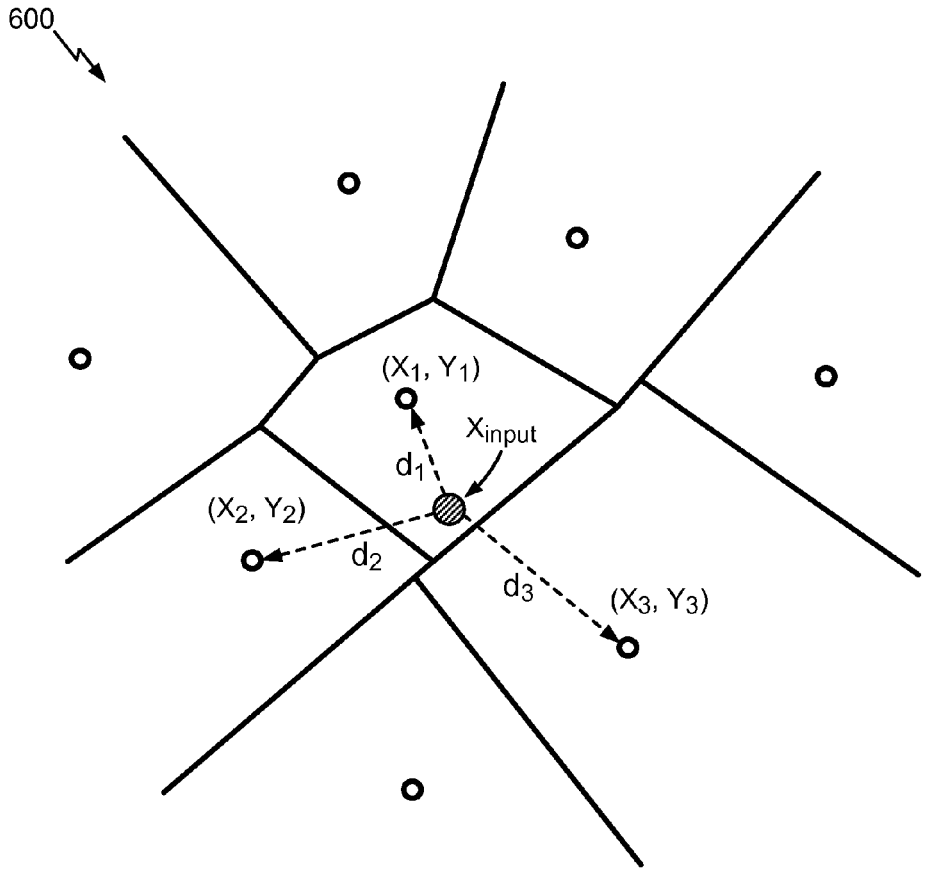
FIG. 6 is a diagram to illustrate a set of high-band parameters predicted using soft vector quantization methods.

Referring to FIG. 6, a graph showing a relation between an input set of low-band parameters and quantization vectors using soft vector quantization methods, such as described with reference to FIG. 5, is depicted and generally designated 600. For ease of illustration, the graph 600 is illustrated as a 2-dimensional graph (e.g., corresponding to 2 low-band LSFs) rather than a higher dimension graph (e.g., 10 dimensions for low-band SLF coefficients). The area of the graph 600 corresponds to potential sets of low-band parameters input into and output from the soft vector quantization module. The potential sets of low-band parameters may be classified into multiple states (e.g., during training and generation of the vector quantization table) illustrated as regions of the graph 600, with each set of low-band parameters (e.g., each point on the graph 600) associated with a particular region. The regions of the graph 600 may correspond to rows of the array of low-band parameters X in the vector quantization table 520 of FIG. 5. Each region of the graph 600 may correspond to a vector that maps a set of low-band parameters (e.g., corresponding to a centroid of the region) to a set of high-band parameters. For example, a first region may be mapped to a vector $(X_1, Y_1)$, a second region may be mapped to a vector $(X_2, Y_2)$, and a third region may be mapped to a vector $(X_3, Y_3)$. The values $X_1$, $X_2$, and $X_3$ may correspond to centroids of the corresponding regions. Each additional region may be mapped to additional vectors. The vectors $(X_1, Y_1)$, $(X_2, Y_2)$, $(X_3, Y_3)$ may correspond to vectors in the vector quantization table 520 of FIG. 5.

In soft vector quantization, an input low-band parameter X may be modeled based on distances (e.g., $d_1$, $d_2$, and $d_3$) between the input low-band parameter X and the vectors $(X_1, Y_1)$, $(X_2, Y_2)$, $(X_3, Y_3)$ in contrast to hard vector quantization, which models the input low-band parameter based on one vector (e.g., the vectors $(X_1, Y_1)$) corresponding to the segment that contains the input low-band parameter. To illustrate, in soft-vector quantization, the modeled input X may be determined conceptually by the equation:

$$X = \frac{1}{d_1}*Y_1+\frac{1}{d_2}*Y_2+\frac{1}{d_3}*Y_3$$

where X is the input low-band parameter to be modeled, $Y_1$, $Y_2$, and $Y_3$ are the centroids of each state (e.g., corresponding to the array of quantized high-band parameters $Y_0$-$Y_n$ of FIG. 5), and $d_1$, $d_2$, and $d_3$, are distances between the input low-band parameter X and each centroid $Y_1$, $Y_2$, and $Y_3$. It should be understood that scaling of the input parameters may be prevented by including a normalization factor. For example, each coefficient $$\left(\text{e.g., } \frac{1}{d_1}, \frac{1}{d_2}, \frac{1}{d_3}\right)$$

may be normalized as described with reference to FIG. 5. As shown in FIG. 6, X may be represented more accurately by using soft-vector quantization than by using hard vector quantization. By extension, a predicted set of high-band parameters based on the soft-vector quantization representation of X may also be more accurate than predicted sets of high-band parameters based on hard-vector quantization.

Figure 7:
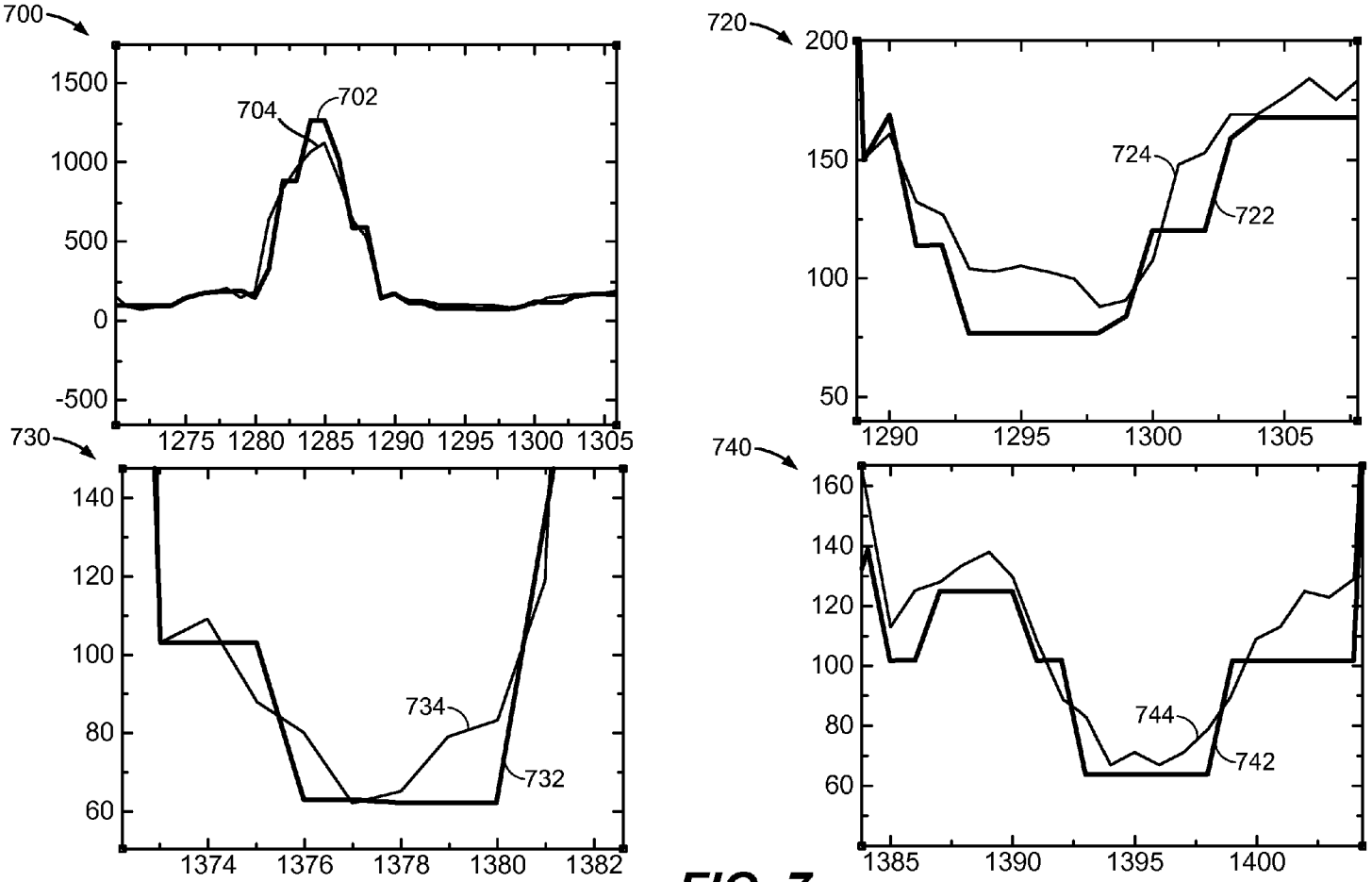
FIG. 7 is a series of graphs comparing high-band gain parameters predicted using soft vector quantization methods to high-band gain parameters predicted using hard vector quantization methods.

As a stream of frames associated with an audio signal is received by the high-band prediction module, increased accuracy of low-band parameters and corresponding predicted high-band parameters associated with each frame may result in a smoother transition of the predicted high-band parameters from frame to frame. FIG. 7 shows a series of graphs 700, 720, 730, and 740 that compare high-band gain parameters (vertical axis) predicted using soft vector quantization methods (e.g., represented by lines 704, 724, 734, and 744) to high-band gain parameters predicted using hard vector quantization methods (represented by lines 702, 722, 732, and 742). As depicted in FIG. 7, the high-band gain parameters predicted using soft-vector quantization include much smoother transitions between frames (horizontal axis).

Figure 8:
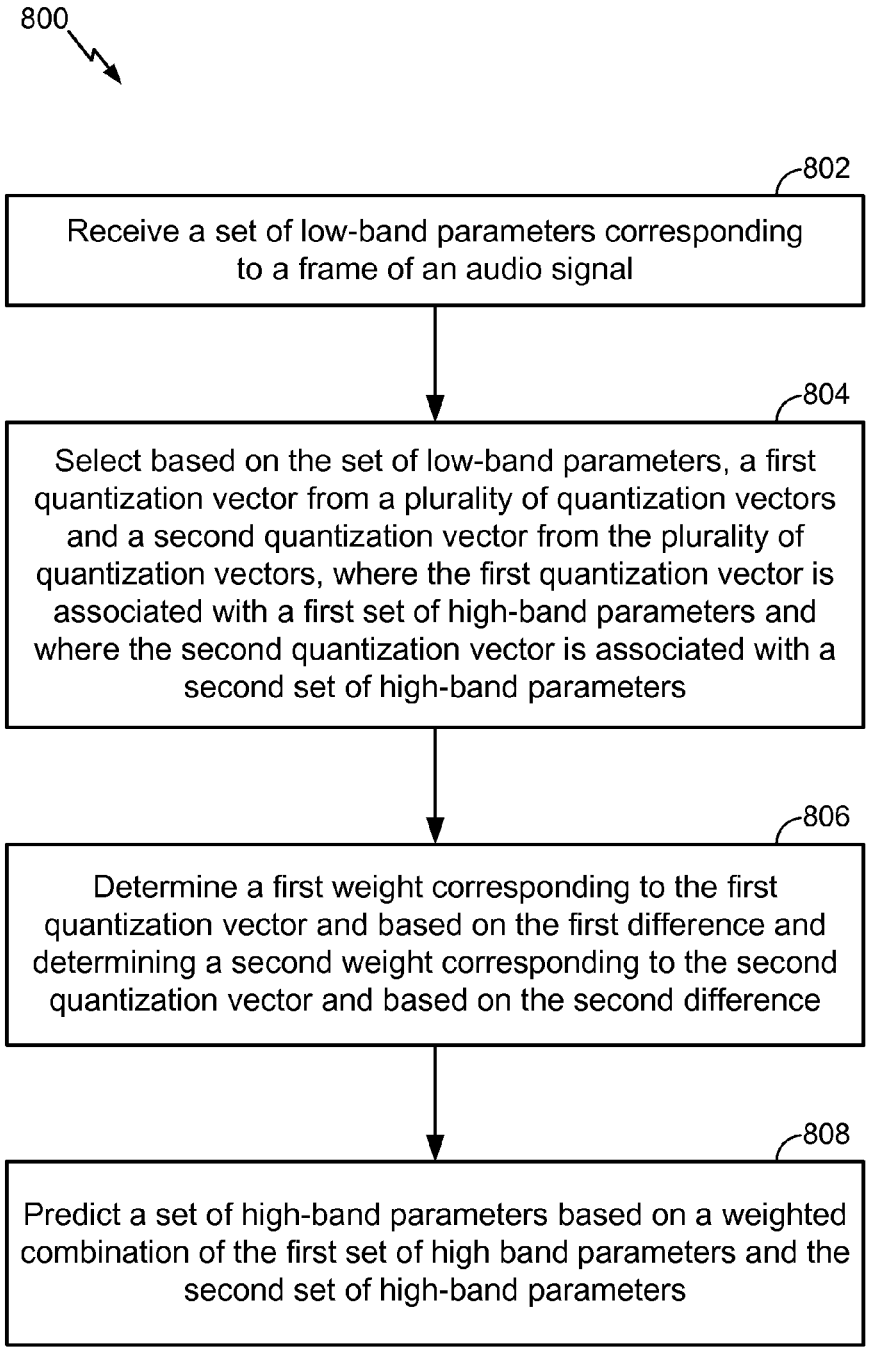
FIG. 8 is a flowchart to illustrate another particular embodiment of a method of performing blind bandwidth extension.

Referring to FIG. 8, a particular embodiment of a method 800 of performing blind bandwidth extension may include receiving a set of low-band parameters corresponding to a frame of an audio signal, at 802. The method 800 may further include selecting, based on the set of low-band parameters, a first quantization vector from a plurality of quantization vectors and a second quantization vector from the plurality of quantization vectors, at 804. The first quantization vector may be associated with a first set of high-band parameters and the second quantization vector may be associated with a second set of high-band parameters. For example, the first quantization vector may correspond to $Y_1$ of the quantization vector table 520 and the second quantization vector may correspond to $Y_2$ of the quantization vector table 520 of FIG. 5. A particular embodiment may include selecting a third quantization vector (e.g., $Y_3$). Other embodiments may include selecting more quantization vectors.

The method 800 may also include determining a first weight corresponding to the first quantization vector and based on the first difference and determining a second weight corresponding to the second quantization vector and based on the second difference, at 806. The method 800 may include predicting a set of high-band parameters based on a weighted combination of the first set of high-band parameters and the second set of high-band parameters, at 808. For example, the high-band parameters 506 of FIG. 5 may be predicted using a weighted sum of the selected quantization vectors $Y_1$, $Y_2$, and $Y_3$.

A predicted set of high-band parameters based on multiple quantization vectors (e.g., soft-vector quantization) as in the method 800 may be more accurate than a prediction based on hard-vector quantization and may lead to smoother transitions of high-band parameters between different frames of an audio signal.

Figure 9:
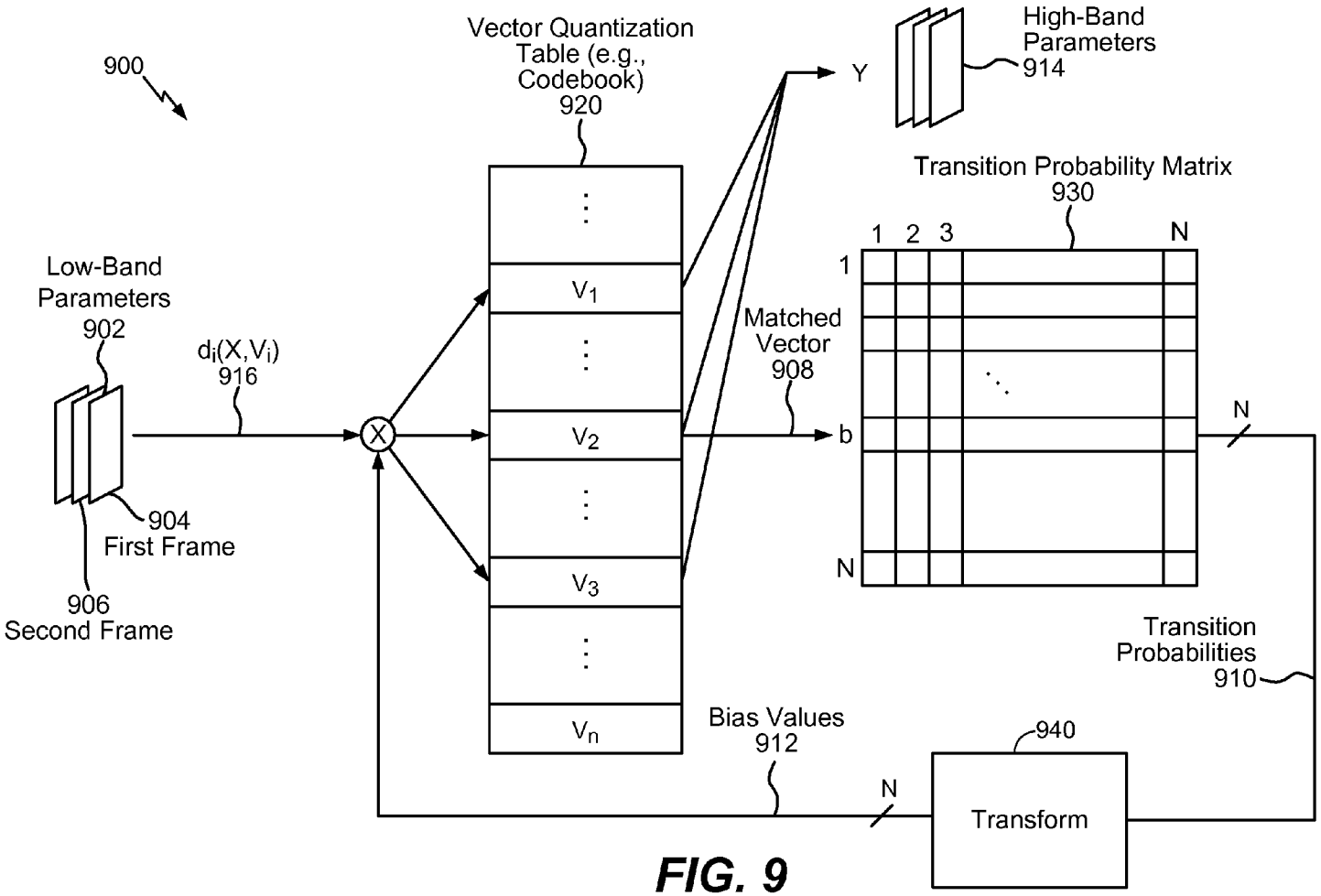
FIG. 9 is a diagram to illustrate a particular embodiment of a probability biased state transition matrix of FIG. 3.

Referring to FIG. 9, a particular embodiment of a system that is operable to perform blind bandwidth extension using soft vector quantization with a probability biased state transition matrix is depicted and generally designated 900. The system 900 includes a vector quantization table 920, a transition probability matrix 930, and a transform module 940. The transition probability matrix 930 may be used to bias a selection of quantization vectors from the vector quantization table 920 based on selected quantization vectors corresponding to preceding frames. The biased selections may enable more accurate selection of quantization vectors.

The vector quantization table 920 may correspond to the vector quantization table 520 of FIG. 5. For example, the quantization vectors $V_0$-$V_n$ of the vector quantization table 920 may correspond to the mappings of quantized low-band parameters $X_0$-$X_n$ to quantized high-band parameters $Y_0$-$Y_n$ of FIG. 5. The system 900 may be configured to receive a stream of low-band parameters 902 corresponding to a low-band audio signal. The stream of low-band parameters 902 may include a first frame corresponding to a first set of low-band parameters 904 and a second frame corresponding to a second set of low-band parameters 906. The system 900 may use the vector quantization table 920 to determine high-band parameters 914 associated with the stream of low-band parameters 902 as described with reference to FIGS. 5-8.

The transition probability matrix 930 may include multiple entries organized into multiple rows and multiple columns. Each row (e.g., rows 1-N) of the transition probability matrix 930 may correspond to a vector of the vector quantization table 920 that may be matched to the first set of low-band parameters 904. Each column (e.g., columns 1-N) of the transition probability matrix may correspond to a vector of the vector quantization table 920 that may be matched to the second set of low-band parameters 906. An entry of the transition probability matrix 930 may correspond to a probability that the second set of low-band parameters 906 will be matched to a vector (indicated by the column of the entry) given that the first set of low-band parameters 904 has been matched to a vector (indicated by the row of the entry). In other words, the transition probability matrix may indicate a probability of transitioning from each vector to each vector of the vector quantization table 920 between frames of the audio signal 902.

To illustrate, distances 916 (represented in FIG. 9 as $d_i(X, V_i)$) between the first set of low-band parameters 904 and the quantization vectors $V_0$-$V_n$ may be used to select multiple matching quantization vectors $V_1$, $V_2$, and $V_3$, as described with reference to FIG. 5. At least one matched vector 908 (e.g., $V_2$) may be used to determine a row (e.g., b) of the transition probability matrix 930. Based on the determined row, a set of transition probabilities 910 may be generated. The set of transition probabilities may indicate probabilities (e.g., corresponding to each quantization vector) that the second set of low-band parameters 906 will match each quantization vector.

The transition probability matrix 930 may be generated based on training data. For example, a database including wideband speech samples may be processed to extract multiple sets of low-band LSFs corresponding to a series of frames of an audio signal. Based on multiple sets of low-band LSFs corresponding to a particular vector of the vector quantization table 920, a probability that a subsequent frame will correspond to each additional vector may be determined along with a probability that the subsequent frame will correspond to the same vector. Based on the probability associated with each vector, the transition probability matrix 930 may be constructed.

After the transition probabilities 910 corresponding to the matched vector 908 have been determined, the transform module 940 may transform the probabilities into bias values. For example, in a particular embodiment the probabilities may be transformed according to the equation:

$$D = \frac{0.1}{0.1 + P_{i,j}}$$

where D is a bias value for biasing the distance 916 between the first set of low-band values 904 corresponding to a first frame and each of the vectors $V_0$-$V_n$ of the vector quantization table 920, and is a probability that the first set of low-band parameters corresponding to a vector $V_i$ during the first frame will transition to the second set of low-band parameters corresponding to a vector $V_j$ during the second frame (e.g., a value at the i-th row, j-th column of the transition probability matrix 930).

A soft vector quantization module, such as the soft vector quantization module 312 of FIG. 3, may be used to select multiple vectors $V_1$, $V_2$, and $V_3$ corresponding to the second set of low-band parameters 906 based on biased distances between the second set of low-band parameters and each vector $V_1$-$V_n$. For example, each distance of the distances 916 may be multiplied by a corresponding bias value of the bias values 912. Based on the biased distances, matching vectors $V_1$, $V_2$, and $V_3$ may be selected (e.g., the three closest matches). The matching vectors $V_1$, $V_2$, and $V_3$ may be used to determine a set of high-band parameters corresponding to the set of low-band parameters 906.

Using the transition probability matrix 930 to determine probabilities of transitioning from a vector to another vector between audio frames and using the probabilities to bias the selection of matching vectors corresponding to subsequent frames may prevent errors in matching vectors from the vector quantization table 920 to the subsequent frames. Hence, the transition probability matrix 930 enables more accurate vector quantization.

Figure 10:
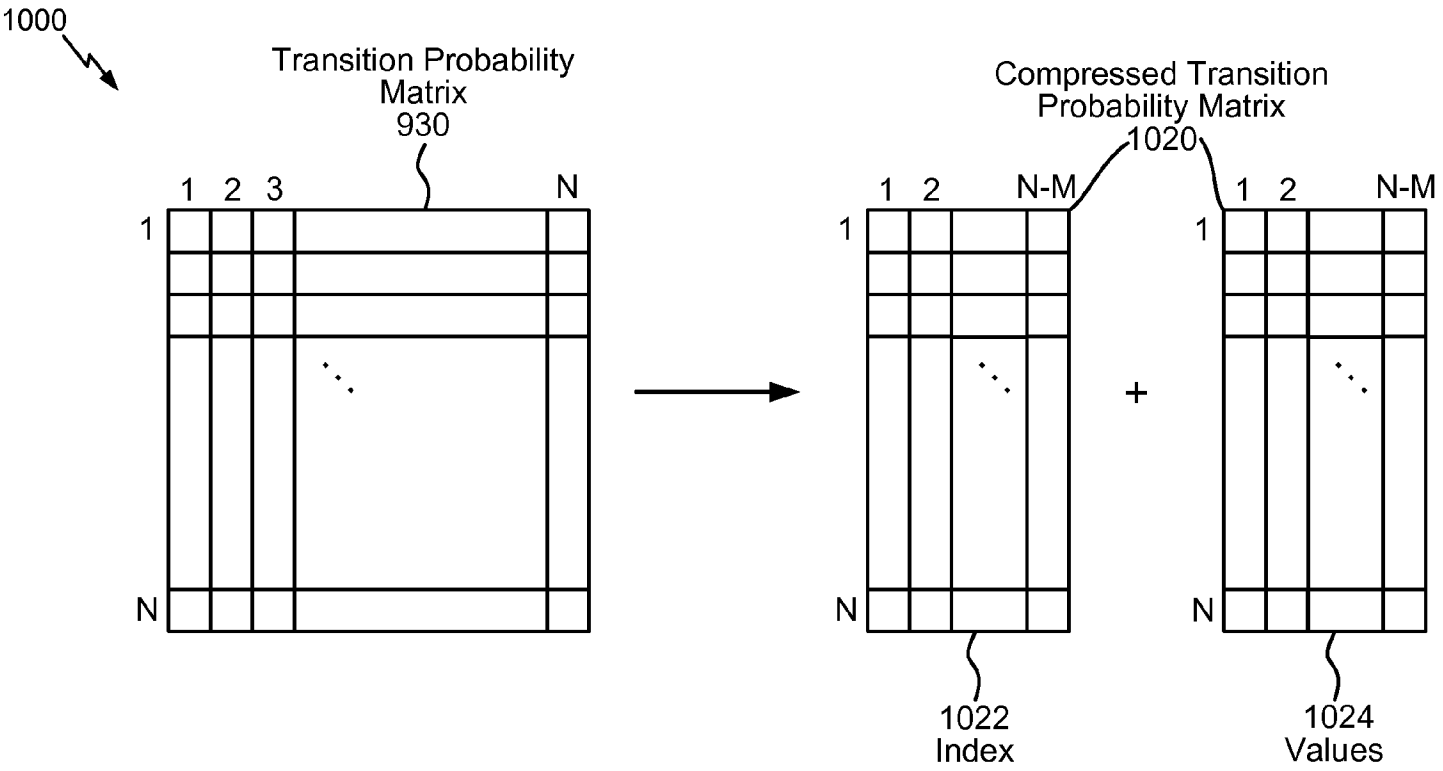
FIG. 10 is a diagram to illustrate another particular embodiment of a probability biased state transition matrix of FIG. 3.

Referring to FIG. 10, the transition probability matrix 930 of FIG. 9 may be compressed into a compressed transition probability matrix 1020. The compressed transition probability matrix 1020 may include an index 1022 and values 1024. Both the index 1022 and the values 1024 may include the same number N of rows as the number of vectors in the vector quantization table 920 of FIG. 9. However, only a subset (e.g., representing the highest probabilities) of the probabilities of transitioning from a first vector to a second vector may be represented in the columns of the index 1022 and the values 1024. For example, a number M of probabilities may not be represented in the compressed transition probability matrix 1020. In a particular exemplary embodiment, the unrepresented probabilities are determined to be zero. The index 1022 may be used to determine which vectors of the vector quantization table 920 the probabilities correspond to, and the values 1024 may be used to determine the value of the probabilities.

By compressing the transition probability matrix according to FIG. 10, space (e.g., in a physical memory and/or in hardware) may be conserved. For example, the size ratio of the compressed transition matrix 1020 to the uncompressed transition probability matrix 930 may be represented by the equation:

$$R = \frac{(N - M) + (N - M)}{N}$$

where N is the number of vectors in the vector quantization table 920 and M is the number of vectors for each row that are not included in the compressed transition probability matrix 1020.

Figure 11:
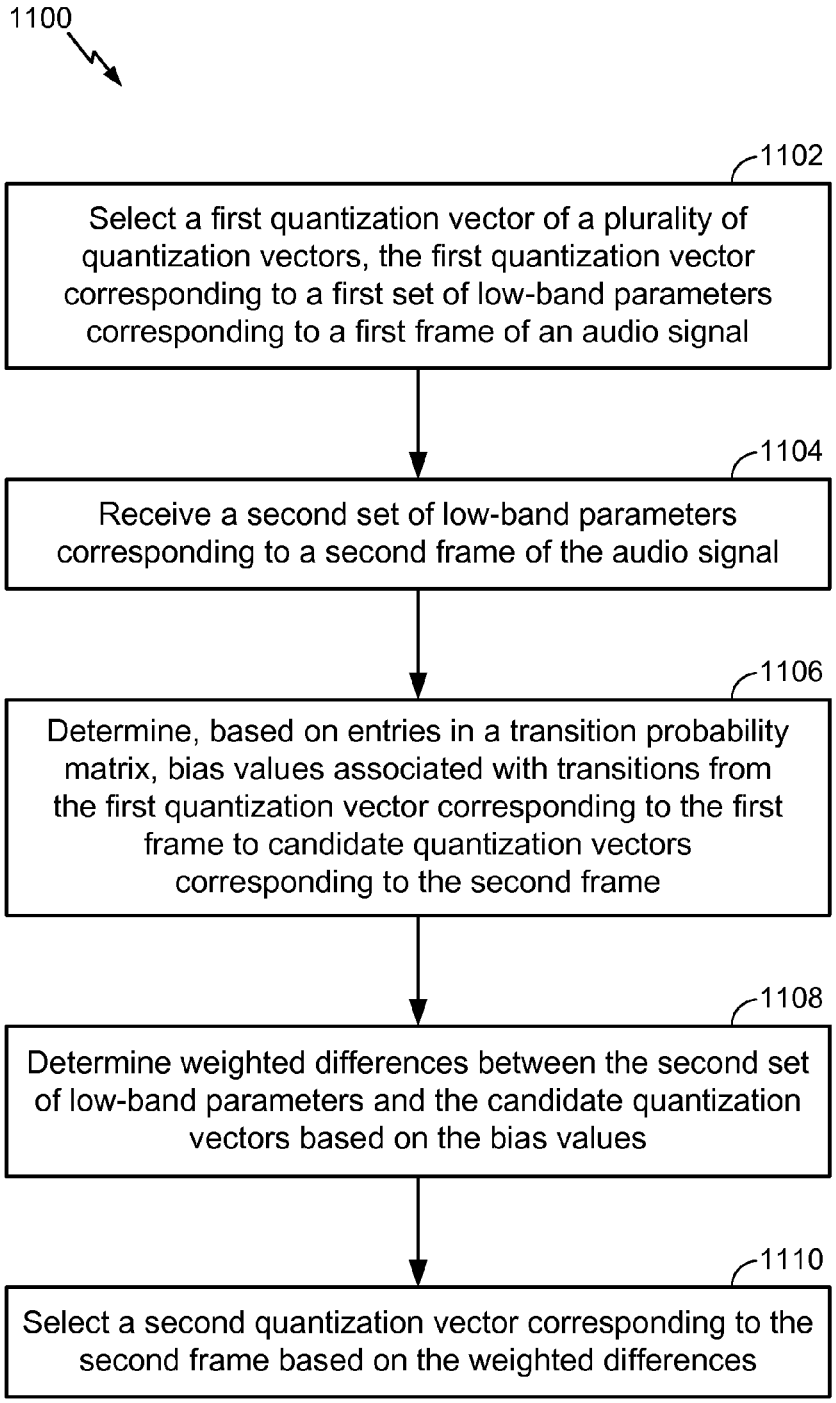
FIG. 11 is a flowchart to illustrate another particular embodiment of a method of performing blind bandwidth extension.

Referring to FIG. 11, a particular embodiment of a method 1100 of performing blind bandwidth extension may include selecting a first quantization vector of a plurality of quantization vectors, at 1102. The first quantization vector may correspond to a first set of low-band parameters corresponding to a first frame of an audio signal. For example, a first quantization vector $V_2$ of the vector quantization table 920 may be selected and may correspond to the first set of low-band parameters 904 of FIG. 9.

The method 1100 may further include receiving a second set of low-band parameters corresponding to a second frame of the audio signal, at 1104. For example, the second set of low-band parameters 906 of FIG. 9 may be received.

The method 1100 may further include determining, based on entries in a transition probability matrix, bias values associated with transitions from the first quantization vector corresponding to the first frame to candidate quantization vectors corresponding to the second frame, at 1106. For example, the bias values 912 may be generated by selecting a row of probabilities b from the transition probability matrix 930 of FIG. 9. Each column of the transition probability matrix 930 may correspond to a candidate quantization vector (e.g., a possible quantization vector for the second frame). As another example, the compressed transition probability matrix 1020 of FIG. 10 may restrict candidate quantization vectors included in the index 1022 for the row corresponding to the first frame.

The method 1100 may also include determining weighted differences between the second set of low-band parameters and the candidate quantization vectors based on the bias values. For example, the distances 916 between the second set of low-band parameters 906 and the vectors $V_0$-$V_n$ of the vector quantization table 920 may be biased according to the bias values 912 of FIG. 9. The method 1100 may include selecting a second quantization vector corresponding to the second frame based on the weighted differences, at 1110.

Using bias values to match the sets of low-band parameters to vectors of the vector quantization table may prevent errors in matching vectors from the vector quantization table to frames and may prevent erroneous high-band parameters from being generated.

Figure 12:
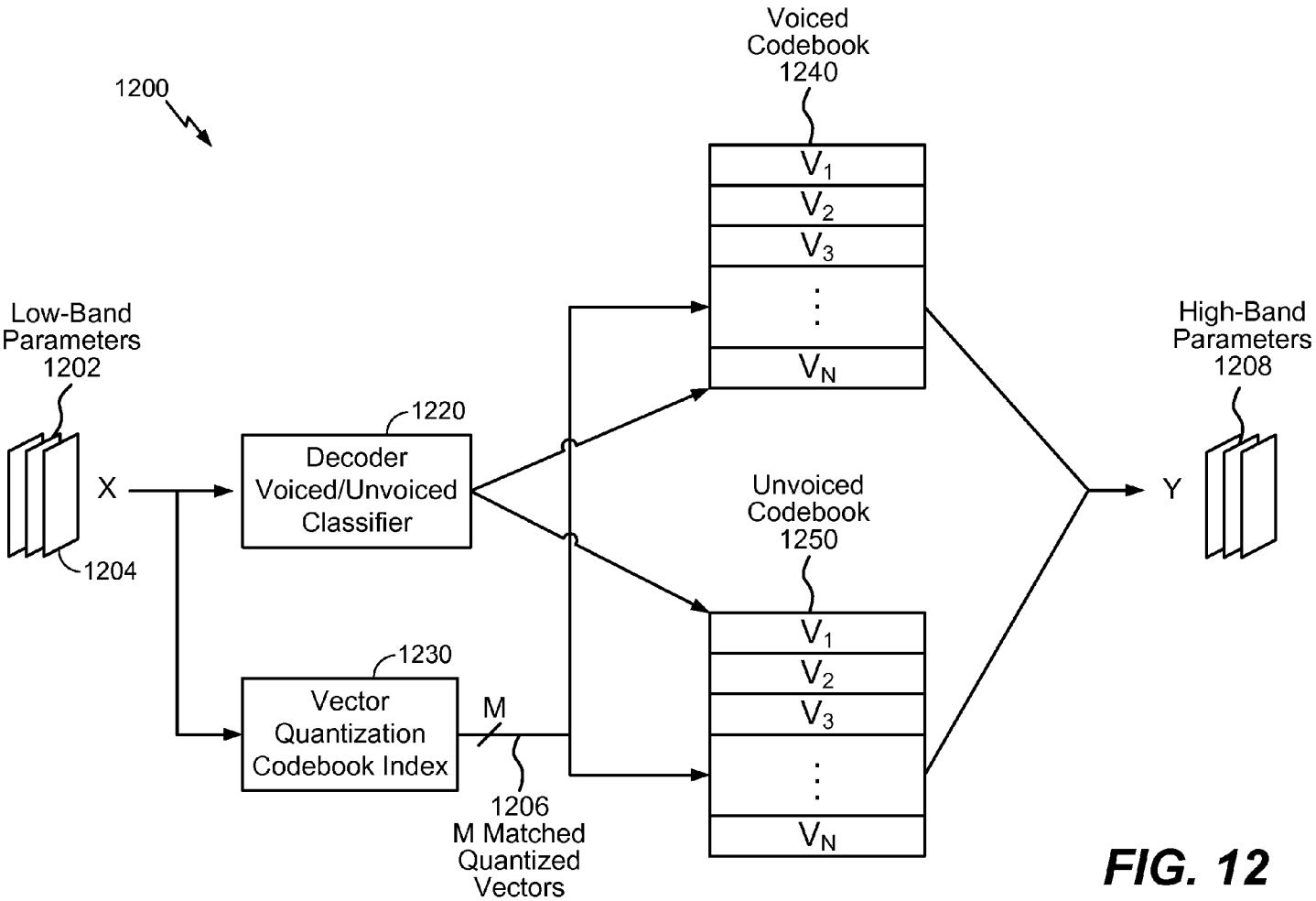
FIG. 12 is a diagram to illustrate a particular embodiment of a voiced unvoiced prediction model switching module of FIG. 3.

Referring to FIG. 12, a diagram to illustrate a particular embodiment of a voiced/unvoiced prediction model switching module is disclosed and generally designated 1200. In a particular embodiment, the voiced/unvoiced prediction model switching module 1200 may correspond to the voiced/unvoiced prediction model switch module 316 of FIG. 3.

The voiced/unvoiced prediction model switching module 1200 includes a decoder voiced/unvoiced classifier 1220 and a vector quantization codebook index module 1230. The voiced/unvoiced prediction model switching module 1200 may include a voiced codebook 1240 and an unvoiced codebook 1250. In a particular embodiment, the voiced/unvoiced prediction model switching module 1200 may include fewer or more than the illustrated modules.

During operation, the decoder voiced/unvoiced classifier 1220 may be configured to select or provide the voiced codebook 1240 when a received set of low-band parameters corresponds to a voiced audio signal and the unvoiced codebook 1250 when the received set of low-band parameters corresponds to an unvoiced audio signal. For example, the decoder voiced/unvoiced classifier 1220 and the vector quantization codebook index module 1230 may receive low-band parameters 1202 corresponding to a low-band audio signal. In a particular embodiment, the low-band parameters 1202 may correspond to the low-band parameters 302 of FIG. 3. The low-band audio signal may be incrementally divided into frames. For example, the low-band parameters 1202 may include a set of parameters corresponding to a frame 1204. In a particular embodiment, the frame 1204 may correspond to the frame 304 of FIG. 3.

The decoder voiced/unvoiced classifier 1220 may classify the set of parameters corresponding to the frame 1204 as voiced or unvoiced. For example, voiced speech may exhibit a high degree of periodicity. Unvoiced speech may exhibit little or no periodicity. The decoder voiced/unvoiced classifier 1220 may classify the set of parameters based on one or more measures of periodicity (e.g., zero crossings, normalized autocorrelation functions (NACFs), or pitch gain) indicated by the set of parameters. To illustrate, the decoder voiced/unvoiced classifier 1220 may determine whether a measure (e.g., zero crossings, NACFs, pitch gain, and/or voice activity) satisfies a first threshold.

In response to determining that the measure satisfies the first threshold, the decoder voiced/unvoiced classifier 1220 may classify the set of parameters of the frame 1204 as voiced. For example, in response to determining that NACF indicated by the set of parameters satisfies (e.g., exceeds) a first voiced NACF threshold (e.g., 0.6), the decoder voiced/unvoiced classifier 1220 may classify the set of parameters of the frame 1204 as voiced. As another example, in response to determining that a number of zero crossings indicated by the set of parameters satisfies (e.g., is below) a zero crossing threshold (e.g., 50), the decoder voiced/unvoiced classifier 1220 may classify the set of parameters of the frame 1204 as voiced.

In response to determining that the measure does not satisfy the first threshold, the decoder voiced/unvoiced classifier 1220 may classify the set of parameters of the frame 1204 as unvoiced. For example, in response to determining that the NACF indicated by the set of parameters does not satisfy (e.g., is below) a second unvoiced NACF threshold (e.g., 0.4), the decoder voiced/unvoiced classifier 1220 may classify the set of parameters of the frame 1204 as unvoiced. As another example, in response to determining that a number of zero crossings indicated by the set of parameters does not satisfy (e.g., exceeds) the zero crossing threshold (e.g., 50), the decoder voiced/unvoiced classifier 1220 may classify the set of parameters of the frame 1204 as unvoiced.

The vector quantization codebook index module 1230 may select one or more quantization vector indices corresponding to one or more matched quantized vectors 1206. For example, the vector quantization codebook index module 1230 may select indices of one or more quantization vectors based on a distance, such as described with respect to FIG. 5, or based on a distance weighted by a transition probability, as described with respect to FIG. 9. In a particular embodiment, the vector quantization codebook index module 1230 may select multiple indices corresponding to a particular codebook (e.g., the voiced codebook 1240 or the unvoiced codebook 1250), as described with reference to FIGS. 5 and 9.

In response to the decoder voiced/unvoiced classifier 1220 classifying the set of parameters of the frame 1204 as voiced, the voiced/unvoiced prediction model switching module 1200 may select a particular quantization vector of the matched quantized vectors 1206 corresponding to a particular quantization vector index of the voiced codebook 1240. For example, the voiced/unvoiced prediction model switching module 1200 may select multiple quantization vectors of the matched quantization vectors 1206 corresponding to multiple quantization vector indices of the voiced codebook 1240.

In response to the decoder voiced/unvoiced classifier 1220 classifying the set of parameters of the frame 1204 as unvoiced, the voiced/unvoiced prediction model switching module 1200 may select a particular quantization vector of the matched quantized vectors 1206 corresponding to a particular quantization vector index of the unvoiced codebook 1250. For example, the voiced/unvoiced prediction model switching module 1200 may select multiple quantization vectors of the matched quantization vectors 1206 corresponding to multiple quantization vector indices of the unvoiced codebook 1250.

A set of high-band parameters 1208 may be predicted based on the selected quantization vector(s). For example, if the decoder voiced/unvoiced classifier 1220 classifies the set of low-band parameters of the frame 1204 as voiced, the set of high-band parameters 1208 may be predicted based on the matched quantization vectors of the voiced codebook 1240. As another example, if the decoder voiced/unvoiced classifier 1220 classifies the set of low-band parameters of the frame 1204 as unvoiced, the set of high-band parameters 1208 may be predicted based on the matched quantization vectors of the voiced codebook 1250.

The voiced/unvoiced prediction model switching module 1200 may predict the high-band parameters 1208 using a codebook (e.g., the voiced codebook 1240 or the unvoiced codebook 1250) that better corresponds to the frame 1204, resulting in increased accuracy of the predicted high-band parameters 1208 as compared to using a single codebook for voiced and unvoiced frames. For example, if the frame 1204 corresponds to voiced audio, the voiced codebook 1240 may be used to predict the high-band parameters 1208. As another example, if the frame 1204 corresponds to unvoiced audio, the unvoiced codebook 1250 may be used to predict the high-band parameters 1208.

Figure 13:
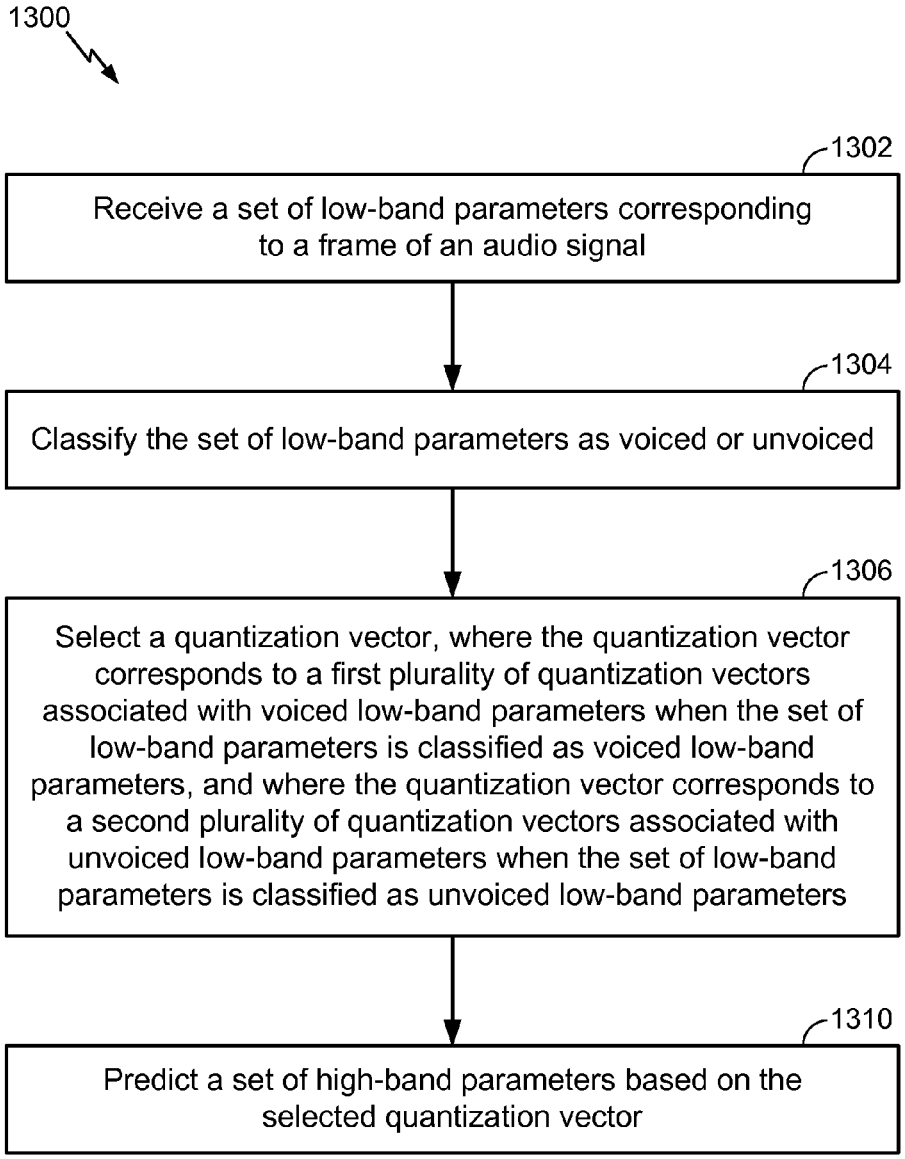
FIG. 13 is a flowchart to illustrate another particular embodiment of a method of performing blind bandwidth extension.

Referring to FIG. 13, a flowchart to illustrate another particular embodiment of a method of performing blind bandwidth extension is disclosed and generally designated 1300. In a particular embodiment, the method 1300 may be performed by the system 100 of FIG. 1, the voiced/unvoiced prediction model switching module 1200 of FIG. 12, or both.

The method 1300 includes receiving a set of low-band parameters corresponding to a frame of an audio signal, at 1302. For example, the voiced/unvoiced prediction model switching module 1200 may receive the set of low-band parameters corresponding to the frame 1204, as described with reference to FIG. 12.

The method 1300 also includes classifying the set of low-band parameters as voiced or unvoiced, at 1304. For example, the decoder voiced/unvoiced classifier 1220 may classify the set of low-band parameters as voiced or unvoiced, as described with reference to FIG. 12.

The method 1300 further includes selecting a quantization vector, where the quantization vector corresponds to a first plurality of quantization vectors associated with voiced low-band parameters when the set of low-band parameters is classified as voiced low-band parameters, and where the quantization vector corresponds to a second plurality of quantization vectors associated with unvoiced low-band parameters when the set of low-band parameters is classified as unvoiced low-band parameters, at 1306. For example, the voiced/unvoiced prediction model switching module 1200 of FIG. 12 may select one or more matched quantization vectors of the voiced codebook 1240 when the set of low-band parameters is classified as voiced, as further described with reference to FIG. 12.

The method 1300 further includes predicting a set of high-band parameters based on the selected quantization vector, at 1310. For example, the voiced/unvoiced prediction model switching module 1200 of FIG. 12 may predict the high-band parameters 1208 based on the selected quantization vector or based on a combination of multiple selected quantization vectors, such as described with respect to FIG. 5 and FIG. 9.

In particular embodiments, the method 1300 of FIG. 13 may be implemented via hardware (e.g., a field-programmable gate array (FPGA) device, an application-specific integrated circuit (ASIC), etc.) of a processing unit, such as a central processing unit (CPU), a digital signal processor (DSP), or a controller, via a firmware device, or any combination thereof. As an example, the method 1300 of FIG. 13 can be performed by a processor that executes instructions, as described with respect to FIG. 19.

Figure 14:
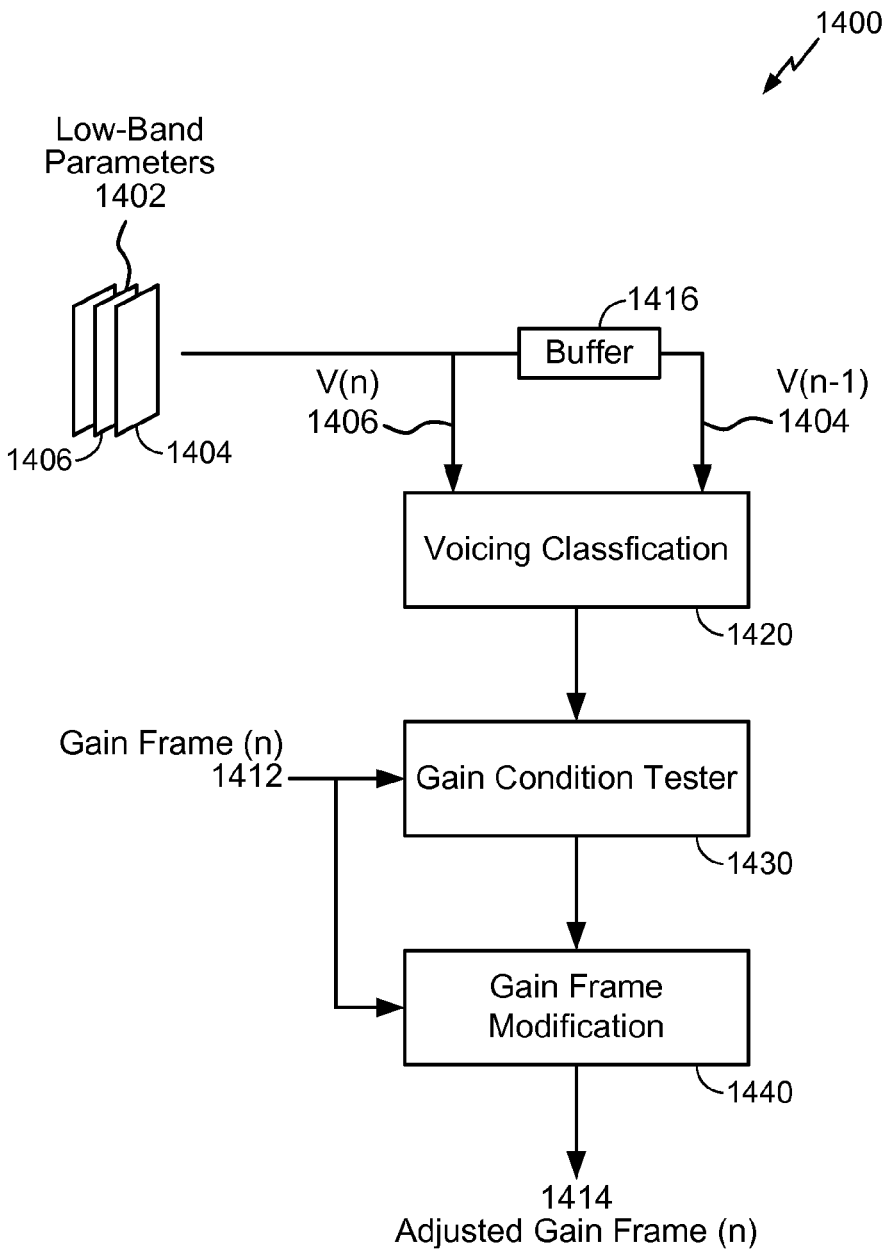
FIG. 14 is a diagram to illustrate a particular embodiment of a multistage high-band error detection module of FIG. 3.

Referring to FIG. 14, a diagram to illustrate a particular embodiment of a multistage high-band error detection module is disclosed and generally designated 1400. In a particular embodiment, the multistage high-band error detection module 1400 may correspond to the multistage high-band error detection module 318 of FIG. 3.

The multistage high-band error detection module 1400 includes a buffer 1416 coupled to a voicing classification module 1420. The voicing classification module 1420 is coupled to a gain condition tester 1430 and to a gain frame modification module 1440. In a particular embodiment, the multistage high-band error detection module 1400 may include fewer or more than the illustrated modules.

During operation, the buffer 1416 and the voicing classification module 1420 may receive low-band parameters 1402 corresponding to a low-band audio signal. In a particular embodiment, the low-band parameters 1402 may correspond to the low-band parameters 302 of FIG. 3. The low-band audio signal may be incrementally divided into frames. For example, the low-band parameters 1402 may include a first set of low-band parameters corresponding to a first frame 1404 and may include a second set of low-band parameters corresponding to a second frame 1406.

The buffer 1416 may receive and store the first set of low-band parameters. Subsequently, the voicing classification module 1420 may receive the second set of low-band parameters and may receive the stored first set of low-band parameters (e.g., from the buffer 1416). The voicing classification module 1420 may classify the first set of low-band parameter as voiced or unvoiced, such as described with reference to FIG. 12. In a particular embodiment, the voicing classification module 1420 may correspond to the decoder voiced/unvoiced classifier 1220 of FIG. 12. The voicing classification module 1420 may also classify the second set of low-band parameters as voiced or unvoiced.

The gain condition tester 1430 may receive a gain frame parameter 1412 (e.g., a predicted high-band gain frame) corresponding to the second frame 1406. In a particular embodiment, the gain condition tester 1430 may receive the gain frame parameter 1412 from the soft vector quantization module 312 and/or the voiced/unvoiced prediction model switch 316 of FIG. 3.

The gain condition tester 1430 may determine whether the gain frame parameter 1412 is to be adjusted based at least partially on the classification (e.g., voiced or unvoiced) of the first set of low-band parameters and of the second set of low-band parameters by the voicing classification module 1420 and based on an energy value corresponding to the second set of low-band parameters. For example, the gain condition tester 1430 may compare the energy value corresponding to the second set of low-band parameters to a threshold energy value, an energy value corresponding to the first set of low-band parameters, or both, based on the classification of the first set of low-band parameters and the second set of low-band parameters. The gain condition tester 1430 may determine whether the gain frame parameter 1412 is to be adjusted based on the comparison, based on determining whether the gain frame parameter 1412 satisfies (e.g., is below) a threshold gain, or both, as further described with reference to FIG. 15. In a particular embodiment, the threshold gain may correspond to a default value. In a particular embodiment, the threshold gain may be determined based on experimental results.

The gain frame modification module 1440 may modify the gain frame parameter 1412 in response to the gain condition tester 1430 determining that the gain frame parameter 1412 is to be adjusted. For example, the gain frame modification module 1440 may modify the gain frame parameter 1412 to satisfy the threshold gain.

The multistage high-band error detection module 1400 may detect whether the gain frame parameter 1412 is unstable (e.g., corresponds to an energy value that is disproportionately higher than energies of adjacent frames or sub-frames) and/or may lead to noticeable artifacts in the generated wide band audio signal. In response to the gain condition tester 1430 determining that a high-band prediction error may have occurred, the multistage high-band error detection module 1400 may adjust the gain frame parameter 1412 to generate an adjusted gain frame parameter 1414, as described further with respect to FIG. 15.

Figure 15:
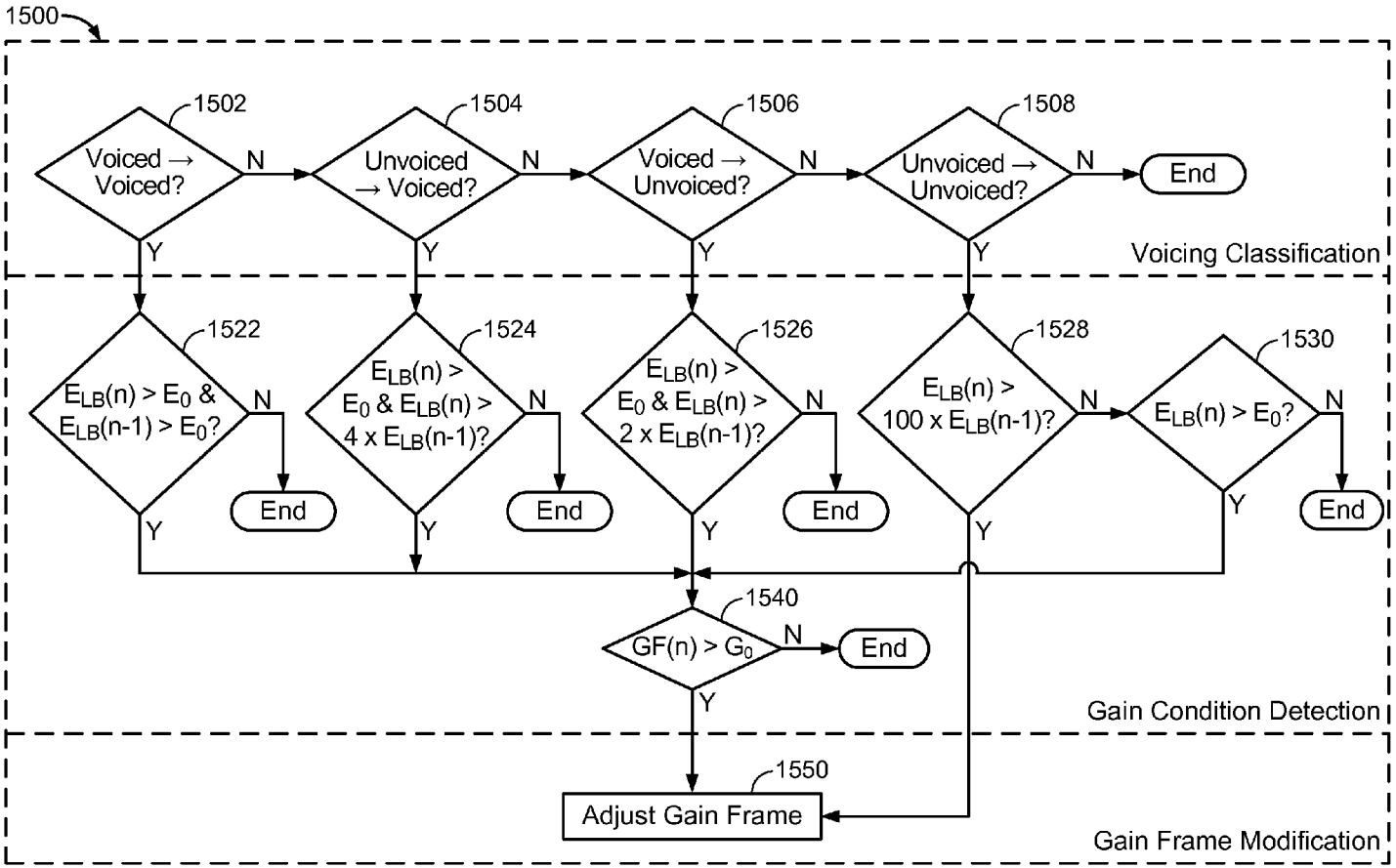
FIG. 15 is a flowchart to illustrate a particular embodiment of multi-state high-band error detection.

Referring to FIG. 15, a flowchart to illustrate another particular embodiment of a method of performing blind bandwidth extension is disclosed and generally designated 1500. In a particular embodiment, the method 1500 may be performed by the system 100 of FIG. 1, the multistage high-band error detection module 1400 of FIG. 14, or both.

The method 1500 includes determining whether a first set of low-band parameters and a second set of low-band parameters are both classified as voiced, at 1502. For example, the gain condition tester 1430 of FIG. 14 may determine whether the first set of low-band parameters corresponding to the first frame 1404 and the second set of low-band parameters corresponding to the second frame 1406 are both classified as voiced by the voicing classification module 1420, as described with reference to FIG. 14.

The method 1500 also includes, in response to determining that at least one of the first set of low-band parameters or the second set of low-band parameters is not classified as voiced, at 1502, determining whether the first set of low-band parameters is classified as unvoiced and the second set of low-band parameters is classified as voiced, at 1504. For example, the gain condition tester 1430 of FIG. 14 may, in response to determining that either the first set of low-band parameters or the second set of low-band parameters is classified as unvoiced, determine whether the first set of low-band parameters is classified as unvoiced and the second set of low-band parameters is classified as voiced by the voicing classification module 1420.

The method 1500 further includes, in response to determining that the first set of low-band parameters is not classified as unvoiced or that the second set of low-band parameters is not classified as voiced, at 1504, determining whether the first set of low-band parameters is classified as voiced and the second set of low-band parameters is classified as unvoiced, at 1506. For example, the gain condition tester 1430 of FIG. 14 may, in response to determining that the first set of low-band parameters is classified as voiced or that the second set of low-band parameters is classified as unvoiced, determine whether the first set of low-band parameters is classified as voiced and the second set of low-band parameters is classified as unvoiced by the voicing classification module 1420.

The method 1500 also includes in response to determining that the first set of low-band parameters is not classified as voiced or that the second set of low-band parameters is not classified as unvoiced, at 1506, determining whether the first set of low-band parameters and the second set of low-band parameters are both classified as unvoiced, at 1508. For example, the gain condition tester 1430 of FIG. 14 may, in response to determining that the first set of low-band parameters is classified as unvoiced or that the second set of low-band parameters is classified as voiced, determine whether the first set of low-band parameters and the second set of low-band parameters are both classified as unvoiced by the voicing classification module 1420.

The method 1500 further includes, in response to determining that the first set of low-band parameters and the second set of low-band parameters are both classified as voiced, at 1502, determining whether a first energy value and a second energy value satisfy (e.g., exceed) a first energy threshold value, at 1522. For example, the gain condition tester 1430 of FIG. 14 may, in response to determining that the first set of low-band parameters and the second set of low-band parameters are both classified as voiced, determine whether a first energy value $E_{LB}(n-1)$ (e.g., indicated by the first low-band parameters) corresponding to the first frame 1404 satisfies (e.g., exceeds) a first energy threshold value $E_0$ and whether a second energy value $E_{LB}(n)$ (e.g., indicated by the second low-band parameters) corresponding to the second frame 1406 satisfies the first energy threshold. In a particular embodiment, the first energy threshold may correspond to a default value. The first energy threshold value may be determined based on experimental results or computed based on an auditory perception model, as illustrative examples.

The method 1500 also includes, in response to determining that the first set of low-band parameters is classified as unvoiced and the second set of low-band parameters is classified as voiced, at 1504, determining whether the second energy value $E_{LB}(n)$ satisfies the first energy threshold value $E_0$ and whether the second energy value is greater than a first multiple (e.g., 4) of the first energy value $E_{LB}(n-1)$, at 1524. For example, the gain condition tester 1430 of FIG. 14 may, in response to determining that the first set of low-band parameters is classified as unvoiced and the second set of low-band parameters is classified as voiced, determine whether the second energy value satisfies the first energy threshold value and whether the second energy value is greater than a first multiple (e.g., 4) of the first energy value.

The method 1500 further includes, in response to determining that the first set of low-band parameters is classified as voiced and the second set of low-band parameters is classified as unvoiced, at 1506, determining whether the second energy value $E_{LB}(n)$ satisfies the first energy threshold value $E_0$ and whether the second energy value is greater than a second multiple (e.g., 2) of the first energy value $E_{LB}(n-1)$, at 1526. For example, the gain condition tester 1430 of FIG. 14 may, in response to determining that the first set of low-band parameters is classified as voiced and the second set of low-band parameters is classified as unvoiced, determine whether the second energy value satisfies the first energy threshold value and whether the second energy value is greater than a second multiple (e.g., 2) of the first energy value.

The method 1500 also includes, in response to determining that the first set of low-band parameters and the second set of low-band parameters are both classified as unvoiced, at 1508, determining whether the second energy value $E_{LB}(n)$ is greater than a third multiple (e.g., 100) of the first energy value $E_{LB}(n-1)$, at 1528. For example, the gain condition tester 1430 of FIG. 14 may, in response to determining that the first set of low-band parameters and the second set of low-band parameters are both classified as unvoiced, determine whether the second energy value is greater than a third multiple (e.g., 100) of the first energy value.

The method 1500 further includes, in response to determining that the second energy value is less than or equal to the third multiple (e.g., 100) of the first energy value, at 1528, determining whether the second energy value $E_{LB}(n)$ satisfies the first energy threshold $E_0$, at 1530. For example, the gain condition tester 1430 of FIG. 14 may, in response to determining that the second energy value is less than or equal to the third multiple (e.g., 100) of the first energy value, determine whether the second energy value satisfies the first energy threshold.

The method 1500 also includes, in response to determining that the first energy value and the second energy value satisfy the first energy threshold, at 1522, that the second energy value satisfies the first energy threshold and the second energy value is greater than the first multiple of the first energy value, at 1524, that the second energy value satisfies the first energy threshold and the second energy value is greater than the second multiple of the first energy value, at 1526, or that the second energy value satisfies the first energy threshold at 1530, determining whether a gain frame parameter satisfies a threshold gain, at 1540. The method 1500 further includes, in response to determining that the gain frame parameter does not satisfy the threshold gain, at 1540, or that the second energy value is greater than the third multiple of the first energy value, at 1528, adjusting the gain frame parameter, at 1550. For example, the gain frame modification module 1440 may adjust the gain frame parameter 1412 in response to determining that the gain frame parameter 1412 does not satisfy the threshold gain or in response to determining that the second energy value is greater than the third multiple of the first energy value, as further described with reference to FIG. 14.

In particular embodiments, the method 1500 of FIG. 15 may be implemented via hardware (e.g., a field-programmable gate array (FPGA) device, an application-specific integrated circuit (ASIC), etc.) of a processing unit, such as a central processing unit (CPU), a digital signal processor (DSP), or a controller, via a firmware device, or any combination thereof. As an example, the method 1500 of FIG. 15 can be performed by a processor that executes instructions, as described with respect to FIG. 19.

Figure 16:
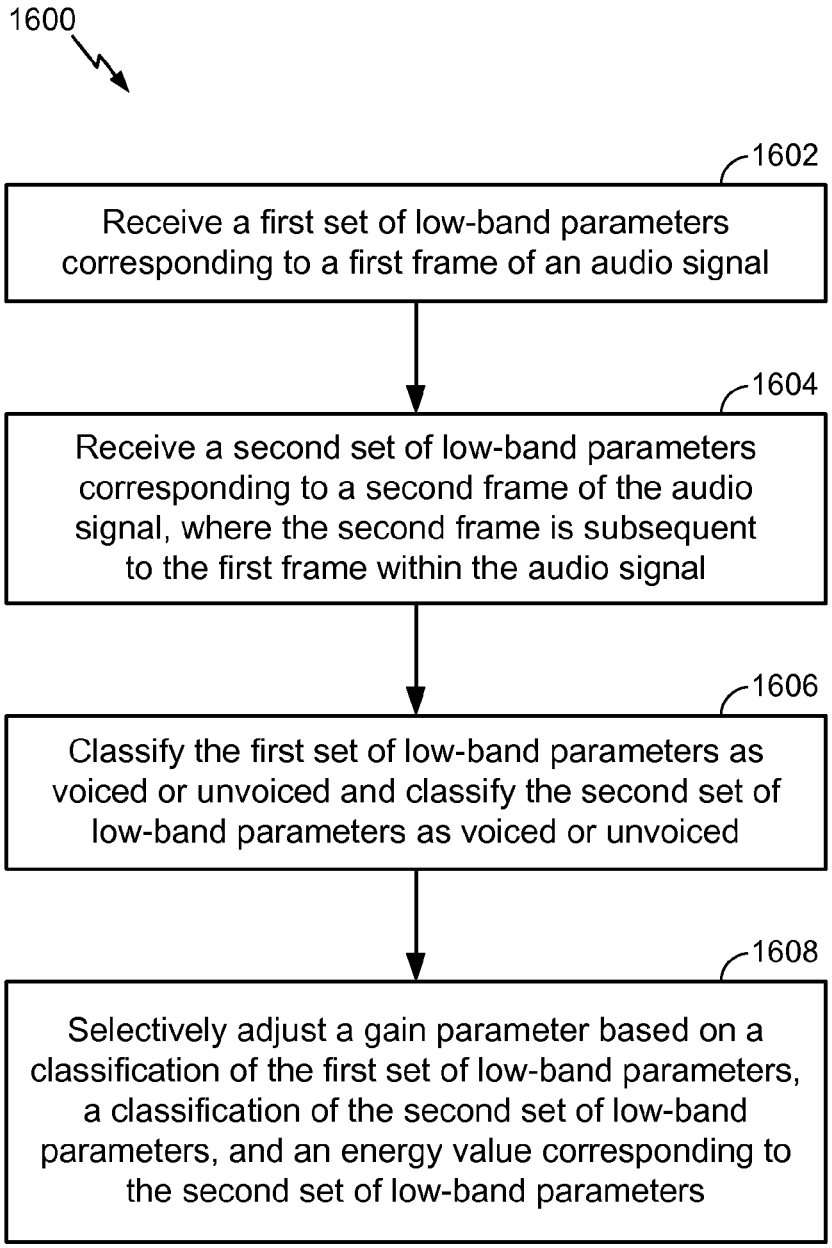
FIG. 16 is a flowchart to illustrate another particular embodiment of a method of performing blind bandwidth extension.

Referring to FIG. 16, a flowchart to illustrate another particular embodiment of a method of performing blind bandwidth extension is disclosed and generally designated 1600. In a particular embodiment, the method 1600 may be performed by the system 100 of FIG. 1, the multistage high-band error detection module 1400 of FIG. 14, or both.

The method 1600 includes receiving a first set of low-band parameters corresponding to a first frame of an audio signal, at 1602. For example, the buffer 1416 of FIG. 14 may receive the first set of low-band parameters corresponding to the first frame 1404, as further described with reference to FIG. 14.

The method 1600 also includes receiving a second set of low-band parameters corresponding to a second frame of the audio signal, at 1604. The second frame may be subsequent to the first frame within the audio signal. For example, the voicing classification module 1420 of FIG. 14 may receive the second set of low-band parameters corresponding to the second frame 1406, as further described with reference to FIG. 14.

The method 1600 further includes classifying the first set of low-band parameters as voiced or unvoiced and classify the second set of low-band parameters as voiced or unvoiced, at 1606. For example, the voicing classification module 1420 of FIG. 14 may classify the first set of low-band parameters as voiced or unvoiced and classify the second set of low-band parameters as voiced or unvoiced, as further described with reference to FIG. 14.

The method 1600 also includes selectively adjusting a gain parameter based on a classification of the first set of low-band parameters, a classification of the second set of low-band parameters, and an energy value corresponding to the second set of low-band parameters, at 1608. For example, the gain frame modification module 1440 may adjust the gain frame parameter 1412 based on the classification of the first set of low-band parameters, the classification of the second set of low-band parameters, and an energy value (e.g., the second energy value $E_{LB}(n)$) corresponding to the second set of low-band parameters, as further described with reference to FIGS. 14-15.

In particular embodiments, the method 1600 of FIG. 16 may be implemented via hardware (e.g., a field-programmable gate array (FPGA) device, an application-specific integrated circuit (ASIC), etc.) of a processing unit, such as a central processing unit (CPU), a digital signal processor (DSP), or a controller, via a firmware device, or any combination thereof. As an example, the method 1600 of FIG. 16 can be performed by a processor that executes instructions, as described with respect to FIG. 19.

Figure 17:
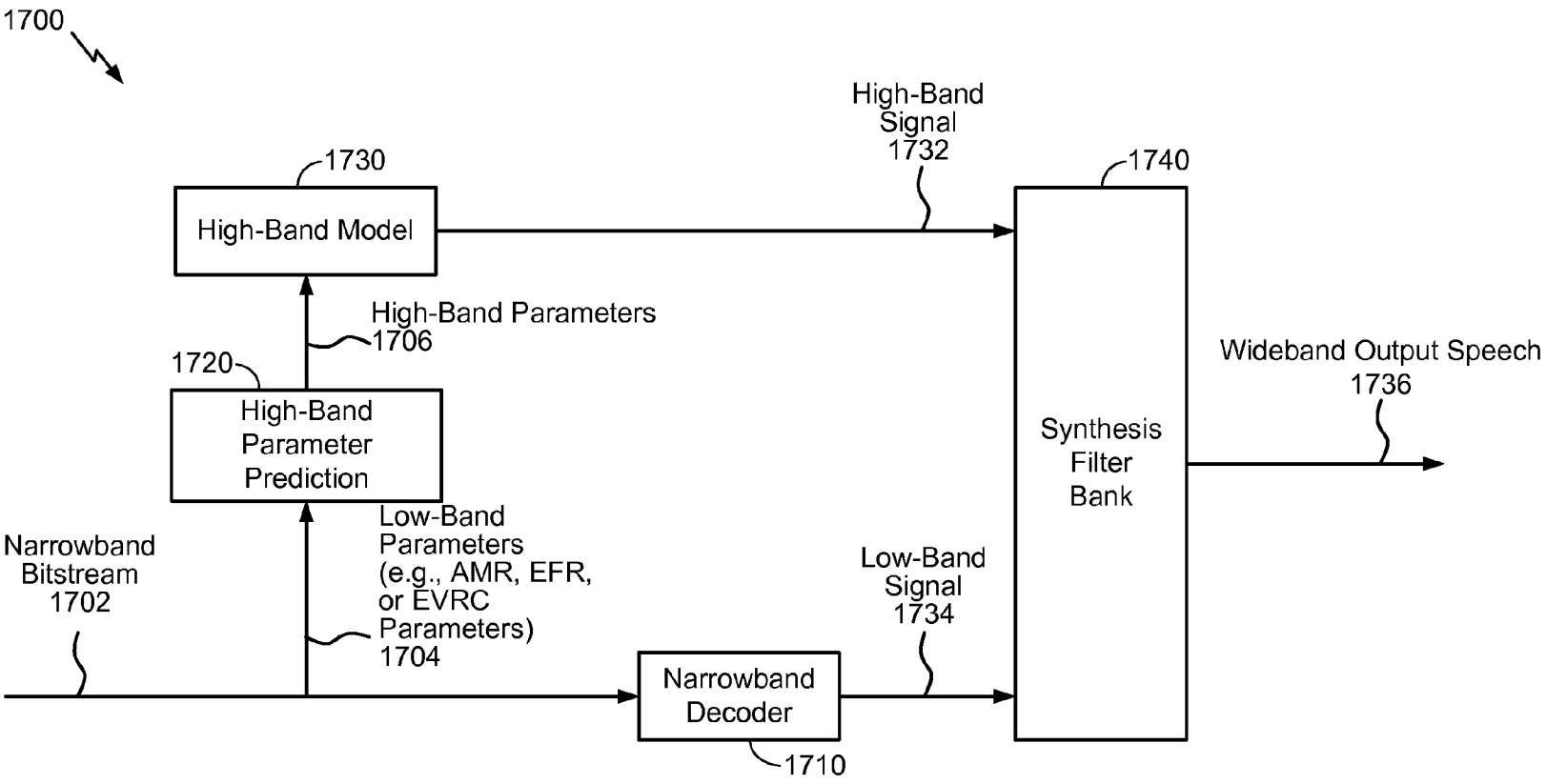
FIG. 17 is a diagram to illustrate a particular embodiment of a system that is operable to perform blind bandwidth extension.

Referring to FIG. 17, a particular embodiment of a system that is operable to perform blind bandwidth extension is depicted and generally designated 1700. The system 1700 includes a narrowband decoder 1710, a high-band parameter prediction module 1720, a high-band model module 1730, and a synthesis filter bank module 1740. The high-band parameter prediction module 1720 may enable the system 1700 to predict high-band parameters based on low-band parameters 1704 extracted from a narrowband bitstream 1702. In a particular embodiment, the system 1700 may be a blind bandwidth extension (BBE) system integrated into a decoding system (e.g., a decoder) of a speech vocoder or apparatus (e.g., in a wireless telephone or coder/decoder (CODEC)).

In the following description, various functions performed by the system 1700 of FIG. 17 are described as being performed by certain components or modules. However, this division of components and modules is for illustration only. In an alternate embodiment, a function performed by a particular component or module may instead be divided amongst multiple components or modules. Moreover, in an alternate embodiment, two or more components or modules of FIG. 17 may be integrated into a single component or module. Each component or module illustrated in FIG. 17 may be implemented using hardware (e.g., an application-specific integrated circuit (ASIC), a digital signal processor (DSP), a controller, a field-programmable gate array (FPGA) device, etc.), software (e.g., instructions executable by a processor), or any combination thereof.

The narrowband decoder 1710 may be configured to receive the narrowband bitstream 1702 (e.g., an adaptive multi-rate (AMR) bitstream, an enhanced full rate (EFR) bitstream, or an enhanced variable rate CODEC (EVRC) bitstream associated with an EVRC, such as EVRC-B). The narrowband decoder 1710 may be configured to decode the narrowband bitstream 1702 to recover a low-band audio signal 1734 corresponding to the narrowband bitstream 1702. In a particular embodiment, the low-band audio signal 1734 may represent speech. As an example, a frequency of the low-band audio signal 1734 may range from approximately 0 hertz (Hz) to approximately 4 kilohertz (kHz). The low-band audio signal 1734 may be in the form of pulse-code modulation (PCM) samples. The low-band audio signal 1734 may be provided to the synthesis filterbank 1740.

The high-band parameter prediction module 1720 may be configured to receive low-band parameters 1704 (e.g., AMR parameters, EFR parameters, or EVRC parameters) from the narrowband bitstream 1702. The low-band parameters 1704 may include linear prediction coefficients (LPC), line spectral frequencies (LSF), gain shape information, gain frame information, and/or other information descriptive of the low-band audio signal 1734. In a particular embodiment, the low-band parameters 1704 include AMR parameters, EFR parameters, or EVRC parameters corresponding to the narrowband bitstream 1702.

Because the system 1700 is integrated into the decoding system (e.g., the decoder) of the speech vocoder, the low-band parameters 1704 from an encoder's analysis (e.g., from an encoder of the speech vocoder) may be accessible to the high-band parameter prediction module 1720 without the use of a "tandeming" process that introduces noise and other errors that reduce the quality of the predicted high-band. For example, conventional BBE systems (e.g., post-processing systems) may perform synthesis analysis in a narrowband decoder (e.g., the narrowband decoder 1710) to generate a low-band signal in the form of PCM samples (e.g., the low-band signal 1734) and additionally perform signal analysis (e.g., speech analysis) on the low-band signal to generate low-band parameters. This tandeming process (e.g., the synthesis analysis and the subsequent signal analysis) introduces noise and other errors that reduce the quality of the predicted high-band. By accessing the low-band parameters 1704 from the narrowband bitstream 1702, the system 1700 may forego the tandeming process to predict the high-band with improved accuracy.

For example, based on the low-band parameters 1704, the high-band parameter prediction module 1720 may generate predicted high-band parameters 1706. The high-band parameter prediction module 1720 may use soft vector quantization to generate the predicted high-band parameters 1706, such as in accordance with one or more of the embodiments described with reference to FIGS. 3-16. By using soft vector quantization, a more accurate prediction of the high-band parameters may be enabled as compared to other high-band prediction methods. Further, the soft vector quantization enables a smooth transition between changing high-band parameters over time.

The high-band model module 1730 may use the predicted high-band parameters 1706 to generate a high-band signal 1732. As an example, a frequency of the high-band signal 1732 may range from approximately 4 kHz to approximately 8 kHz. In a particular embodiment, the high-band model module 1730 may use the predicted high-band parameters 1706 and low-band residual information (not shown) generated from the narrowband decoder 1710 to generate the high-band signal 1732, in a similar manner as described with respect to FIG. 1.

The synthesis filter bank 1740 may be configured to receive the high-band signal 1732 and the low-band signal 1734 and generate a wideband output 1736. The wideband output 1736 may include a wideband speech output that includes the decoded low-band audio signal 1734 and the predicted high-band audio signal 1732. A frequency of the wideband output 1736 may range from approximately 0 Hz to approximately 8 kHz, as an illustrative example. The wideband output 1736 may be sampled (e.g., at approximately 16 kHz) to reconstruct the combined low-band and high-band signals.

The system 1700 of FIG. 17 may improve accuracy of the high-band signal 132 may foregoing the tandeming process used by conventional BBE systems. For example, the low-band parameters 1704 may be accessible to the high-band parameter prediction module 1720 because the system 1700 is a BBE system implemented into a decoder of a speech vocoder.

The integration of the system 1700 into the decoder of the speech vocoder may support other integrated functions of the speech vocoder that are supplemental features of the speech vocoder. As non-limiting examples, homing sequences, in-band signaling of network features/controls, and in-band data modems may be supported by the system 1700. For example, by integrating the system 1700 (e.g., the BBE system) with the decoder, a homing sequence output of a wideband vocoder may be synthesized such that the homing sequence may be passed across narrowband junctures (or wideband junctures) in a network (e.g., interoperation scenarios). For in-band signaling or in-band modems, the system 1700 may allow the decoder to remove in-band signals (or data), and the system 1700 may synthesize a wideband bitstream that includes the signals (or data) as opposed to a conventional BBE system in which in-band signals (or data) are lost through tandeming.

Although the system 1700 of FIG. 17 is described being integrated (e.g., accessible) to the decoder of a speech vocoder, in other embodiments, the system 1700 may be used as part of an "interworking function" positioned at a juncture between a legacy narrowband network and a wideband network. For example, the interworking function may use the system 1700 to synthesize wideband from a narrowband input (e.g., the narrowband bitstream 1702) and encode the synthesized wideband with a wideband vocoder. Thus, the interworking function may synthesize wideband output in the form of PCM (e.g., the wideband output 1736), which is then re-encoded by a wideband vocoder.

Alternatively, the interworking function may predict the high-band from the narrowband parameters (e.g., without using the narrowband PCM) and encode a wideband vocoder bitstream without using the wideband PCM). A similar approach may be used in conference bridges to synthesize a wideband output (e.g., the wideband outputs speech 1736) from multiple narrowband inputs.

Figure 18:
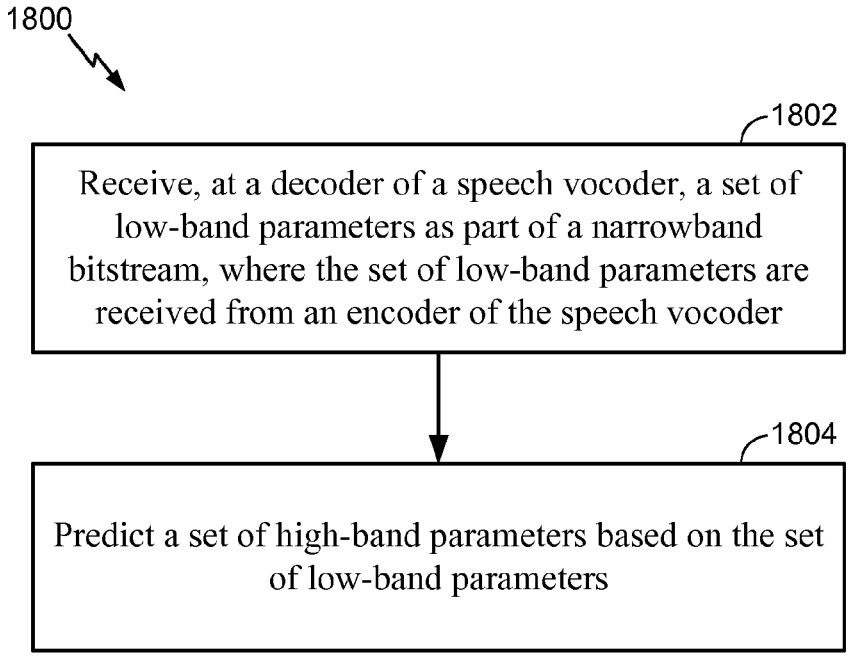
FIG. 18 is a flowchart to illustrate a particular embodiment of a method of performing blind bandwidth extension.

Referring to FIG. 18, a flowchart to illustrate a particular embodiment of a method of performing blind bandwidth extension is disclosed and generally designated 1800. In a particular embodiment, the method 1800 may be performed by the system 1700 of FIG. 17.

The method 1800 includes receiving, at a decoder of a speech vocoder, a set of low-band parameters as part of a narrowband bitstream, at 1802. For example, referring to FIG. 17, the high-band parameter prediction module 1720 may receive the low-band parameters 1704 (e.g., AMR parameters, EFR parameters, or EVRC parameters) from the narrowband bitstream 1702. The low-band parameters 1704 may be received from an encoder of the speech vocoder. For example, the low-band parameters 1704 may be received from the system 100 of FIG. 1.

A set of high-band parameters may be predicted based on the set of low-band parameters, at 1804. For example, referring to FIG. 17, the high-band parameter prediction module 1720 may predict the high-band parameters 1706 based on the low-band parameters 1704.

The method 1800 of FIG. 18 may reduce noise (and other errors that reduce the quality of the predicted high-band) by receiving the low-band parameters 1704 from the encoder of the speech vocoder. For example, the low-band parameters 1704 may be accessible to the high-band parameter prediction module 1720 without the use of a "tandeming" process that introduces noise and other errors that reduce the quality of the predicted high-band. For example, conventional BBE systems (e.g., post-processing systems) may perform synthesis analysis in a narrowband decoder (e.g., the narrowband decoder 1710) to generate a low-band signal in the form of PCM samples (e.g., the low-band signal 1734) and additionally perform signal analysis (e.g., speech analysis) on the low-band signal to generate low-band parameters. This tandeming process (e.g., the synthesis analysis and the subsequent signal analysis) introduces noise and other errors that reduce the quality of the predicted high-band. By accessing the low-band parameters 1704 from the narrowband bitstream 1702, the system 1700 may forego the tandeming process to predict the high-band with improved accuracy.

Figure 19:
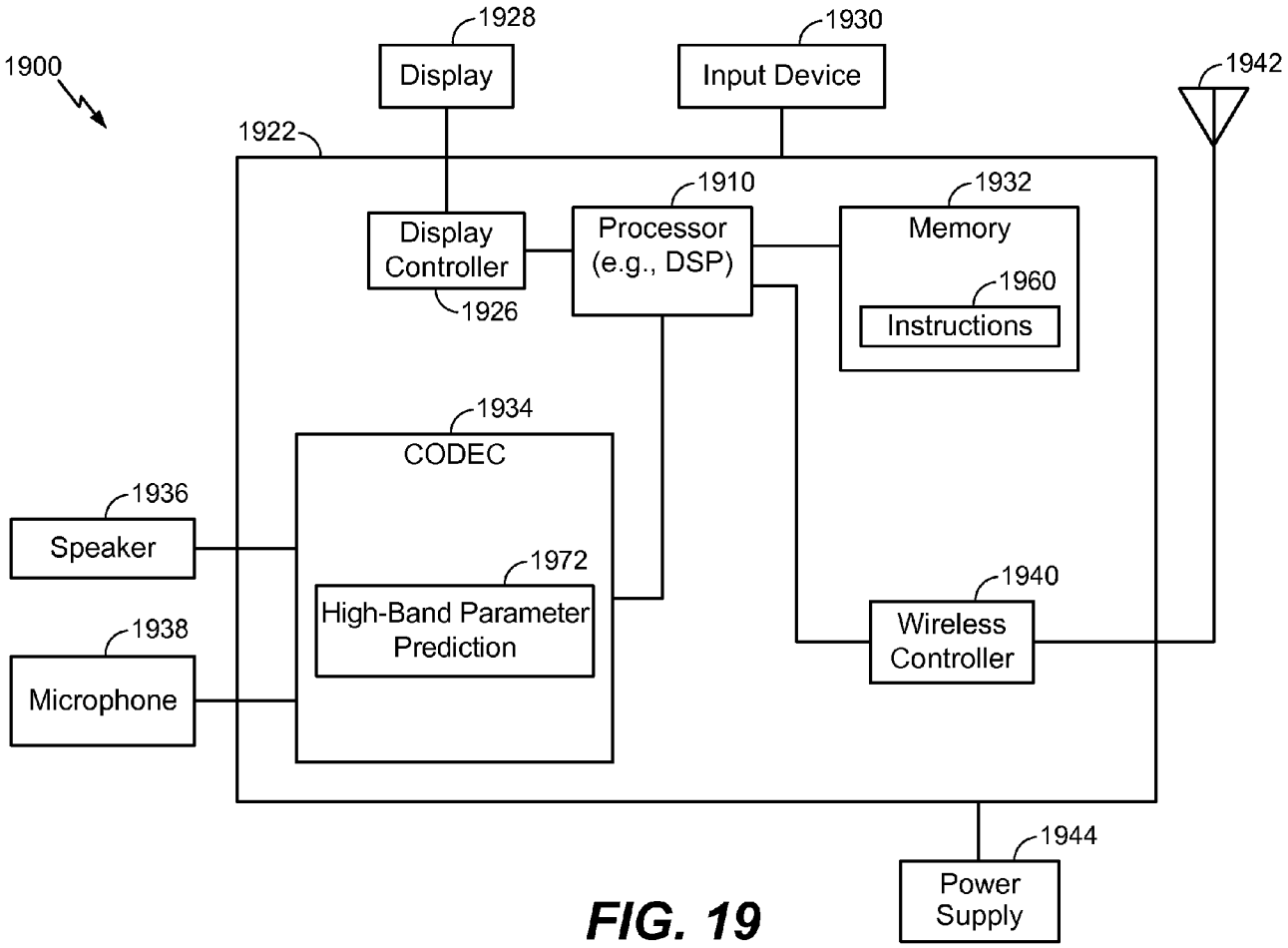
FIG. 19 is a block diagram of a wireless device operable to perform blind bandwidth extension operations in accordance with the systems and methods of FIGS. 1-18.

Referring to FIG. 19, a block diagram of a particular illustrative embodiment of a device (e.g., a wireless communication device) is depicted and generally designated 1900. The device 1900 includes a processor 1910 (e.g., a central processing unit (CPU), a digital signal processor (DSP), etc.) coupled to a memory 1932. The memory 1932 may include instructions 1960 executable by the processor 1910 and/or a coder/decoder (CODEC) 1934 to perform methods and processes disclosed herein, such as the method 200 of FIG. 2, the method 400 of FIG. 4, the method 800 of FIG. 8, the method 1100 of FIG. 11, the method 1300 of FIG. 13, the method 1500 of FIG. 15, the method 1600 of FIG. 16, the method 1800 of FIG. 18, or a combination thereof. The CODEC 1934 may include a high-band parameter prediction module 1972. In a particular embodiment, the high-band parameter prediction module 1972 may correspond to the high-band parameter prediction module 120 of FIG. 1.

One or more components of the system 1900 may be implemented via dedicated hardware (e.g., circuitry), by a processor executing instructions to perform one or more tasks, or a combination thereof. As an example, the memory 1932 or one or more components of the high-band parameter prediction module 1972 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 1960) that, when executed by a computer (e.g., a processor in the CODEC 1934 and/or the processor 1910), may cause the computer to perform at least a portion of one of the method 200 of FIG. 2, the method 400 of FIG. 4, the method 800 of FIG. 8, the method 1100 of FIG. 11, the method 1300 of FIG. 13, the method 1500 of FIG. 15, the method 1600 of FIG. 16, the method 1800 of FIG. 18, or a combination thereof. As an example, the memory 1932 or the one or more components of the CODEC 1934 may be a non-transitory computer-readable medium that includes instructions (e.g., the instructions 1960) that, when executed by a computer (e.g., a processor in the CODEC 1934 and/or the processor 1910), cause the computer perform at least a portion of the method 200 of FIG. 2, the method 400 of FIG. 4, the method 800 of FIG. 8, the method 1100 of FIG. 11, the method 1300 of FIG. 13, the method 1500 of FIG. 15, the method 1600 of FIG. 16, the method 1800 of FIG. 18, or a combination thereof.

FIG. 19 also shows a display controller 1926 that is coupled to the processor 1910 and to a display 1928. The CODEC 1934 may be coupled to the processor 1910, as shown. A speaker 1936 and a microphone 1938 can be coupled to the CODEC 1934. In a particular embodiment, the processor 1910, the display controller 1926, the memory 1932, the CODEC 1934, and the wireless controller 1940 are included in a system-in-package or system-on-chip device (e.g., a mobile station modem (MSM)) 1922. In a particular embodiment, an input device 1930, such as a touchscreen and/or keypad, and a power supply 1944 are coupled to the system-on-chip device 1922. Moreover, in a particular embodiment, as illustrated in FIG. 19, the display 1928, the input device 1930, the speaker 1936, the microphone 1938, the antenna 1942, and the power supply 1944 are external to the system-on-chip device 1922. However, each of the display 1928, the input device 1930, the speaker 1936, the microphone 1938, the antenna 1942, and the power supply 1944 can be coupled to a component of the system-on-chip device 1922, such as an interface or a controller.

Those of skill would further appreciate that the various illustrative logical blocks, configurations, modules, circuits, and algorithm steps described in connection with the embodiments disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. A method comprising:

determining, based on multiple quantized low-band parameters and a set of low-band parameters of an audio signal, a first set of high-band parameters and a second set of high-band parameters, wherein a number of the multiple quantized low-band parameters is changed from frame to frame of the audio signal; and predicting a set of high-band parameters based on a weighted combination of the first set of high-band parameters and the second set of high-band parameters.

2. The method of claim 1, wherein the first set of high-band parameters and the second set of high-band parameters are determined based on weighted differences between the multiple quantized low-band parameters and the set of low-band parameters of the audio signal, wherein the number of the multiple quantized low-band parameters is adaptively changed from frame to frame of the audio signal, and further comprising extracting the set of low-band parameters from a signal received at a mobile device and converting the predicted set of high-band parameters from a non-linear domain to a linear domain to obtain a set of linear domain high-band parameters.

3. The method of claim 1, wherein the set of low-band parameters are included in a narrowband bitstream received at a speech vocoder, and wherein the set of low-band parameters includes a first set of low-band parameters corresponding to a first frame of the audio signal.

4. The method of claim 3, wherein determining the first set of high-band parameters and the second set of high-band parameters comprises:

selecting a first state from a plurality of states of a vectorization table based on the first set of low-band parameters; and selecting a second state from the plurality of states of the vectorization table based on the first set of low-band parameters, wherein the first state is associated with the first set of high-band parameters and the second state is associated with the second set of high-band parameters.

5. The method of claim 4, further comprising:

selecting a particular state of the first state and the second state;

receiving a second set of low-band parameters corresponding to a second frame of the audio signal;

determining, based on entries in a transition probability matrix, bias values associated with transitions from the particular state to candidate states;

determining differences between the second set of low-band parameters and the candidate states based on the bias values; and selecting a state corresponding to the second frame based on the differences.

6. The method of claim 3, further comprising:

receiving a second set of low-band parameters corresponding to a second frame of the audio signal;

classifying the first set of low-band parameters as voiced or unvoiced;

classifying the second set of low-band parameters as voiced or unvoiced; and selectively adjusting a gain parameter of the second frame based on a first classification of the first set of low-band parameters, a second classification of the second set of low-band parameters, a first energy value corresponding to the first set of low-band parameters, and a second energy value corresponding to the second set of low-band parameters.

7. The method of claim 6, wherein selectively adjusting the gain parameter comprises, when the first set of low-band parameters is classified as voiced and the second set of low-band parameters is classified as voiced:

when the first energy value exceeds a threshold energy value and when the second energy value exceeds the threshold energy value, adjusting the gain parameter in response to the gain parameter exceeding a threshold gain.

8. The method of claim 6, wherein selectively adjusting the gain parameter comprises, when the first set of low-band parameters is classified as unvoiced and the second set of low-band parameters is classified as voiced:

when the second energy value exceeds a threshold energy value and when the second energy value exceeds a first multiple of the first energy value, adjusting the gain parameter in response to the gain parameter exceeding a threshold gain.

9. The method of claim 6, wherein selectively adjusting the gain parameter comprises, when the first set of low-band parameters is classified as voiced and the second set of low-band parameters is classified as unvoiced:

when the second energy value exceeds a threshold energy value and when the second energy value exceeds a second multiple of the first energy value, adjusting the gain parameter in response to the gain parameter exceeding a threshold gain.

10. The method of claim 6, wherein selectively adjusting the gain parameter comprises, when the first set of low-band parameters is classified as unvoiced and the second set of low-band parameters is classified as unvoiced:

when the second energy value exceeds a third multiple of the first energy value and when the second energy value exceeds a threshold energy value, adjusting the gain parameter in response to the gain parameter exceeding a threshold gain.

11. The method of claim 1, wherein the determining and the predicting are performed within a device that comprises a mobile communication device.

12. The method of claim 1, wherein the determining and the predicting are performed within a device that comprises a fixed location communication unit.

13. An apparatus comprising:

a processor; and a memory storing instructions executable by the processor to perform operations comprising:

determining, based on multiple quantized low-band parameters and a set of low-band parameters of an audio signal, a first set of high-band parameters and a second set of high-band parameters, wherein a number of the multiple quantized low-band parameters is changed from frame to frame of the audio signal; and predicting a set of high-band parameters based on a weighted combination of the first set of high-band parameters and the second set of high-band parameters.

14. The apparatus of claim 13, wherein the operations further comprise converting the predicted set of high-band parameters from a non-linear domain to a linear domain to obtain a set of linear domain high-band parameters, wherein the set of low-band parameters includes a first set of low-band parameters corresponding to a first frame of the audio signal, and wherein determining the first set of high-band parameters and the second set of high-band parameters comprises:

selecting a first state from a plurality of states of a vectorization table based on the first set of low-band parameters; and selecting a second state from the plurality of states of the vectorization table based on the first set of low-band parameters, wherein the first state is associated with the first set of high-band parameters and the second state is associated with the second set of high-band parameters.

15. The apparatus of claim 14, wherein the operations further comprise:

selecting a particular state of the first state and the second state;

receiving a second set of low-band parameters corresponding to a second frame of the audio signal;

determining, based on entries in a transition probability matrix, bias values associated with transitions from the particular state to candidate states;

determining differences between the second set of low-band parameters and the candidate states based on the bias values; and selecting a state corresponding to the second frame based on the differences.

16. The apparatus of claim 13, wherein the set of low-band parameters includes a first set of low-band parameters corresponding to a first frame of the audio signal, and wherein the operations further comprise:

receiving a second set of low-band parameters corresponding to a second frame of the audio signal;

classifying the first set of low-band parameters as voiced or unvoiced;

classifying the second set of low-band parameters as voiced or unvoiced; and selectively adjusting a gain parameter of the second frame based on a first classification of the first set of low-band parameters, a second classification of the second set of low-band parameters, a first energy value corresponding to the first set of low-band parameters, and a second energy value corresponding to the second set of low-band parameters.

17. The apparatus of claim 16, wherein selectively adjusting the gain parameter comprises, when the first set of low-band parameters is classified as voiced and the second set of low-band parameters is classified as voiced:

when the first energy value exceeds a threshold energy value and when the second energy value exceeds the threshold energy value, adjusting the gain parameter in response to the gain parameter exceeding a threshold gain.

18. The apparatus of claim 16, wherein selectively adjusting the gain parameter comprises, when the first set of low-band parameters is classified as unvoiced and the second set of low-band parameters is classified as voiced:

when the second energy value exceeds a threshold energy value and when the second energy value exceeds a first multiple of the first energy value, adjusting the gain parameter in response to the gain parameter exceeding a threshold gain.

19. The apparatus of claim 16, wherein selectively adjusting the gain parameter comprises, when the first set of low-band parameters is classified as voiced and the second set of low-band parameters is classified as unvoiced:

when the second energy value exceeds a threshold energy value and when the second energy value exceeds a second multiple of the first energy value, adjusting the gain parameter in response to the gain parameter exceeding a threshold gain.

20. The apparatus of claim 16, wherein selectively adjusting the gain parameter comprises, when the first set of low-band parameters is classified as unvoiced and the second set of low-band parameters is classified as unvoiced:

when the second energy value exceeds a third multiple of the first energy value and when the second energy value exceeds a threshold energy value, adjusting the gain parameter in response to the gain parameter exceeding a threshold gain.

21. The apparatus of claim 13, further comprising:

an antenna; and a receiver coupled to the antenna and configured to receive a signal corresponding to the audio signal.

22. The apparatus of claim 21, wherein the processor, the memory, the receiver, and the antenna are integrated into a mobile communication device.

23. The apparatus of claim 21, wherein the processor, the memory, the receiver, and the antenna are integrated into a fixed location communication unit.

24. A non-transitory computer-readable medium comprising instructions that, when executed by a processor, cause the processor to:

determine, based on multiple quantized low-band parameters and a set of low-band parameters of an audio signal, a first set of high-band parameters and a second set of high-band parameters, wherein a number of the multiple quantized low-band parameters is changed from frame to frame of the audio signal; and predict a set of high-band parameters based on a weighted combination of the first set of high-band parameters and the second set of high-band parameters.

25. The non-transitory computer-readable medium of claim 24, wherein the instructions are further executable to cause the processor to convert the predicted set of high-band parameters from a non-linear domain to a linear domain to obtain a set of linear domain high-band parameters, wherein the set of low-band parameters include a first set of low-band parameters corresponding to a first frame of the audio signal, and wherein determining the first set of high-band parameters and the second set of high-band parameters comprises:

selecting a first state from a plurality of states of a vectorization table based on the first set of low-band parameters; and selecting a second state from the plurality of states of the vectorization table based on the first set of low-band parameters, wherein the first state is associated with the first set of high-band parameters and the second state is associated with the second set of high-band parameters.

26. The non-transitory computer-readable medium of claim 25, wherein the instructions are further executable to cause the processor to:

select a particular state of the first state and the second state;

receive a second set of low-band parameters corresponding to a second frame of the audio signal;

determine, based on entries in a transition probability matrix, bias values associated with transitions from the particular state to candidate states;

determine differences between the second set of low-band parameters and the candidate states based on the bias values; and select a state corresponding to the second frame based on the differences.

27. The non-transitory computer-readable medium of claim 24, wherein the set of low-band parameters include a first set of low-band parameters corresponding to a first frame of the audio signal, and wherein the instructions are further executable to cause the processor to:

receive a second set of low-band parameters corresponding to a second frame of the audio signal;

classify the first set of low-band parameters as voiced or unvoiced;

classify the second set of low-band parameters as voiced or unvoiced; and selectively adjust a gain parameter of the second frame based on a first classification of the first set of low-band parameters, a second classification of the second set of low-band parameters, a first energy value corresponding to the first set of low-band parameters, and a second energy value corresponding to the second set of low-band parameters.

28. An apparatus comprising:

means for determining, based on multiple quantized low-band parameters and a set of low-band parameters of an audio signal, a first set of high-band parameters and a second set of high-band parameters, wherein a number of the multiple quantized low-band parameters is changed from frame to frame of the audio signal; and means for predicting a set of high-band parameters based on a weighted combination of the first set of high-band parameters and the second set of high-band parameters.

29. The apparatus of claim 28, further comprising means for converting the predicted set of high-band parameters from a non-linear domain to a linear domain to obtain a set of linear domain high-band parameters, wherein the set of low-band parameters include a first set of low-band parameters corresponding to a first frame of the audio signal, and wherein the means for determining the first set of high-band parameters and the second set of high-band parameters comprises:

means for selecting a first state from a plurality of states of a vectorization table based on the first set of low-band parameters; and means for selecting a second state from the plurality of states of the vectorization table based on the first set of low-band parameters, wherein the first state is associated with the first set of high-band parameters and the second state is associated with the second set of high-band parameters.

30. The apparatus of claim 28, wherein the means for determining and the means for predicting are integrated into a mobile communication device.

31. The apparatus of claim 28, wherein the means for determining and the means for predicting are integrated into a fixed location communication unit.

* * * * *